US007246601B2

(12) United States Patent
Yamamoto et al.

(10) Patent No.: US 7,246,601 B2
(45) Date of Patent: Jul. 24, 2007

(54) COMMON RAIL

(75) Inventors: Akiyoshi Yamamoto, Chiryu (JP); Yoshinori Ohmi, Kariya (JP); Jun Kondo, Gamogori (JP); Keizo Jyoko, Okazaki (JP)

(73) Assignee: DENSO Corporation (JP)

( * ) Notice: Subject to any disclaimer, the term of this patent is extended or adjusted under 35 U.S.C. 154(b) by 66 days.

(21) Appl. No.: 11/218,559

(22) Filed: Sep. 6, 2005

(65) Prior Publication Data

US 2006/0054139 A1 Mar. 16, 2006

(30) Foreign Application Priority Data

Sep. 10, 2004 (JP) ..... 2004-264455
Feb. 24, 2005 (JP) ..... 2005-049543

(51) Int. Cl.
*F02M 55/02* (2006.01)

(52) U.S. Cl. ..... 123/456; 123/468

(58) Field of Classification Search ..... 123/456, 123/468, 469

See application file for complete search history.

(56) References Cited

U.S. PATENT DOCUMENTS 5,288,350 A * 2/1994 Kita ..... 156/73.1
5,591,359 A * 1/1997 Saitou et al. ..... 219/121.64
5,898,646 A * 4/1999 Kasaya et al. ..... 368/281
5,957,507 A 9/1999 Asada
6,212,038 B1 * 4/2001 Kishida ..... 360/133
6,223,970 B1 * 5/2001 Chen ..... 228/44.3
6,302,616 B1 * 10/2001 Takahashi ..... 403/271
6,736,431 B2 5/2004 Jung et al.
2004/0195837 A1 10/2004 Kondo et al.
2005/0018890 A1 * 1/2005 McDonald et al. ..... 382/128

FOREIGN PATENT DOCUMENTS

JP 58-013481 1/1983
JP 58-168483 10/1983
JP 06-106359 4/1994
JP 2002-283058 10/2002

* cited by examiner

*Primary Examiner*—Thomas Moulis
(74) *Attorney, Agent, or Firm*—Nixon & Vanderhye PC

(57) ABSTRACT

A ring-shaped connecting portion is formed on a seat surface side of a pipe connector. The connecting portion is tapered so that thickness thereof gradually reduces toward a tip end thereof. A protrusion is formed on the tip end of the connecting portion. A ring-shaped groove is formed on a flat outer peripheral surface of a common rail. By fitting the protrusion into the groove, the connector can be positioned to a predetermined position of the common rail. In this structure, current can be concentrated to the protrusion and current density can be increased. As a result, sufficient bonding strength can be attained.

21 Claims, 22 Drawing Sheets

COMMON RAIL

CROSS REFERENCE TO RELATED APPLICATION

This application is based on and incorporates herein by reference Japanese Patent Application No. 2004-264455, filed on Sep. 10, 2004, and Japanese Patent Application No. 2005-49543 filed on Feb. 24, 2005.

BACKGROUND OF THE INVENTION

1. Field of the Invention

The present invention relates to a bonding method and bonding configuration for bonding a connecting member or a mounting stay, which is used in a pressure accumulation fuel injection system, to a surface of a metal base material through welding. The present invention also relates to a common rail mounted on a common rail fuel injection system, which injects fuel into an internal combustion engine, for accumulating high-pressure fuel. Specifically, the present invention relates to a bonded common rail that is formed by welding multiple parts.

2. Description of Related Art

When a pipe connector is bonded to a common rail of a pressure accumulation fuel injection system of an internal combustion engine, strength and positional accuracy of the bonded portion are required.

International Publication No. 01/66934 (WO '934) discloses a convex positioning portion on an outer peripheral surface of the common rail. The connector is fit to the positioning portion to ensure positional accuracy. Thus, WO '934 performs the welding process to ensure bonding strength.

In a resistance welding process, a current is conducted through contacting points of the common rail and the connector to be bonded, and the common rail and the connector are welded with the use of heat that is generated at the contacting points by electric resistance at the contacting points. Therefore, if the current flows through a positioning portion, which is not the contacting points, the density of the current flowing through the contacting points is reduced, and the bonding strength becomes insufficient. Therefore, WO '934 discloses interposing an insulating ring between the positioning portion and the connector to prevent the current from flowing through the positioning portion during the resistance welding process.

However, since the technology described in WO '934 uses the insulator ring, which does not provide any improvement in performance of the product, cost is increased unnecessarily.

In a pressure accumulation fuel injection system, the common rail is mounted to the internal combustion engine through a mounting stay. Therefore, positional accuracy of the mounting stay with respect to the common rail is important. If the bonding position of the mounting stay is deviated when the mounting stay is bonded to the common rail, it affects the positional accuracy of the connector with respect to the common rail. Usually, the positional accuracy of the mounting stay with respect to the common rail is ensured by performing jig adjustment.

A method that ensures the positional accuracy of the mounting stay with respect to the common rail by a jig adjustment cannot absorb a dimensional error of the common rail or the mounting stay. Therefore, if an error occurs, e.g., in length of the common rail or the external diameter of the mounting stay, the positional accuracy of the mounting stay with respect to the common rail is deteriorated. Also, if thermal expansion of the common rail is caused by heat generation when the resistance welding process is performed, the positional accuracy of the mounting stay is deteriorated by the influence of the thermal expansion.

A forged common rail is manufactured by forming a rail main body that accumulates high-pressure fuel and joints for pipe connection in a single piece through a forging process.

A bonded common rail is described in JP-A-2005-9672. Multiple parts of the bonded common rail are produced separately and are bonded with each other through a welding process. The bonded common rail can improve productivity and reduce cost compared to a forged common rail. Joint type common rails (for example, as shown in FIGS. 33A to 34C) and sleeve type common rails (for example, as shown in FIGS. 35A to 35C) are examples of bonded common rails.

As shown in FIG. 33A, a rail main body 70, a cylindrical connector 72, and a joint 23 for pipe connection of the joint type common rail are manufactured separately, first. A first flat surface 74, to which the connector 72 is to be bonded, is formed on an upper surface of the rail body 70 in FIG. 33A along a longitudinal direction. Then, the rail main body 70 and the connector 72 are bonded through electric resistance welding process, and the joint 23 is fastened to the connector 72. Thus, the joint type common rail is manufactured as shown in FIG. 33B. A conical portion 33 on a tip end of each one of pipes 56, 57 is connected to the joint 23 by threading a pipe fastening nut 35 to the joint 23 as shown in FIG. 33C. The joint 23 is made of a metal material of iron family. A joint passage 28 is formed at the axial center of the joint 23. The joint passage 28 communicates an inside-outside communication hole 76 with an inner passage of each one of the pipes 56, 57.

A main body side male thread 29 is formed on an end of the joint 23. The main body side male thread 29 is screwed into a connector thread 77. A pipe side male thread 30 is formed on the other end of the joint 23. The pipe side male thread 30 is used to connect the pipe 56, 57.

A second flat surface 31 is formed on an end surface of the joint 23, on which the main body side male thread 29 is formed. The second flat surface 31 coincides with the first flat surface 74 of the rail main body 70. More specifically, the second flat surface 31 is formed on the end surface of the main body side male thread 29 to surround the joint passage 28.

The main body side male thread 29 is screwed into the connector thread 77, and the tip end of the main body side male thread 29 is pushed deeply into the connector 72. Thus, the joint passage 28 opening in the second flat surface 31 communicates with the inside-outside communication hole 76 opening in the first flat surface 74, and the second flat surface 31 around the joint passage 28 is pressed against the first flat surface 74 around the inside-outside communication hole 76 to form a main body sealing surface (oil-tight surface) 32.

A pressure receiving seat surface 34 in a conically tapered shape is formed on the end surface of the joint 23 on a side where the pipe side male thread 30 is formed. The conical portion 33 formed on a tip end of each one of the pipes 56, 57 is inserted into the pressure receiving seat surface 34. The joint passage 28 opens in the bottom of the pressure receiving seat surface 34.

A nut thread (female thread) 36 is formed on an inner peripheral surface of the pipe fastening nut 35, which is fit to each one of the pipes 56, 57. The pipe side male thread 30 is threaded with the nut thread 36. The pipe fastening nut 35 is threaded with the pipe side male thread 30 of the joint 23 in a state in which the pipe fastening nut 35 strikes the step formed on the backside of the conical portion 33 of each one of the pipes 56, 57. By threading the pipe fastening nut 35 to the pipe side male thread 30, the conical portion 33 of each one of the pipes 56, 57 is pressed against the pressure receiving seat surface 34 to form a pipe sealing surface (oil-tight surface) 37.

As shown in FIG. 34A, a rail main body 70, a cylindrical connector 82, and a joint 23 for pipe connection of the joint type common rail are manufactured separately, first. A first flat surface 74, to which the connector 82 is to be bonded, is formed on an upper surface of the rail body 70 in FIG. 34A along a longitudinal direction. Then, the rail main body 70 and the connector 82 are bonded through laser welding process, and the joint 23 is fastened to the connector 82. Thus, the joint type common rail is manufactured as shown in FIG. 34B.

The main body side male thread 29 is screwed into a connector thread 87 of the connector 82, and the tip end of the main body side male thread 29 is pushed deeply into the connector 82. Thus, the joint passage 28 opening in the second flat surface 31 communicates with the inside-outside communication hole 76 opening in the first flat surface 74, and the second flat surface 31 around the joint passage 28 is pressed against the first flat surface 74 around the inside-outside communication hole 76 to form a main body sealing surface (oil-tight surface) 32.

A rail main body 80 and a cylindrical connector 92 of the sleeve type common rail are manufactured separately as shown in FIG. 35A. Then, the rail main body 80 and the connector 92 are bonded through electric resistance welding process (or laser welding process). Thus, as shown in FIG. 35B, the sleeve type common rail is manufactured. A conical portion 133 on a tip end of each one of pipes 66, 67 and a part of a sleeve 143 are inserted into the connector 92, and a pipe fastening nut 135 is threaded to the connector 92. Thus, the conical portion 133 on the tip end of each one of the pipes 66, 67 is connected directly to a pressure receiving seat surface 134 of the rail main body 80. A first flat surface 84 is formed on an upper surface of the rail main body 80 in FIG. 35A. An inside-outside communication hole 86 opens in the bottom of the pressure receiving seat surface 134. A nut thread 136 is formed on an inner peripheral surface of the pipe fastening nut 135. The connector 92 is formed with a connector thread 127. The conical portion 133 and the pressure receiving seat surface 134 form a main body sealing surface (oil-tight surface) 137.

Since the forged common rail is manufactured in a single piece through a forging process, shape accuracy of respective parts can be improved. Since the bonded common rail is manufactured by manufacturing respective parts (for example, the rail main body 70, 80 and the connector 72, 82, 92) separately and by welding the parts, it has been difficult to attain the same shape accuracy as that of the forged common rail.

Specifically, the part bonded to a flat surface is affected by shape accuracy of a welding jig. Therefore, it has been difficult to manufacture the bonded common rail with high accuracy.

SUMMARY OF THE INVENTION

It is an object of the present invention to provide a bonding configuration and bonding method of a connecting member capable of ensuring bonding strength and positional accuracy without using part(s) that provide no improvement performance of the product. It is another object of the present invention to provide a bonding method of a mounting stay capable of ensuring positional accuracy of the mounting stay with respect to a common rail without being affected by a dimensional error of a product or thermal expansion of the common rail. It is yet another object of the present invention to improve bonding accuracy of a common rail that is manufactured by welding a first member such as a rail main body and a second member such as a connector.

According to an aspect of the present invention, a connecting member is bonded through a resistance welding process to a metal base material used in a pressure accumulation fuel injection system that injects high-pressure fuel accumulated in a common rail into an internal combustion engine through an injector. The connecting member is formed with an annular connecting portion, the thickness of which is gradually reduced toward a tip end thereof. The connecting member is also formed with a protrusion on the tip end thereof. The metal base material is formed with a ring-shaped groove on a surface thereof complementary to the protrusion. The resistance welding process is performed by concentrating a current to the protrusion while the connecting member is positioned in a predetermined position with respect to the metal base material by fitting the protrusion and the groove with each other.

Thus, the connecting member can be positioned in a predetermined position with respect to the metal base material by fitting the protrusion formed on the connecting portion of the connecting member to the groove formed on the surface of the metal base material. The groove and the protrusion as positioning portions are formed on the two parts, e.g., the metal base material and the connecting member, that are bonded through the resistance welding process. Thus, the positional accuracy of the connecting member is improved.

The thickness of the connecting portion is gradually reduced toward the tip end thereof, and the protrusion is formed on the tip end. Therefore, the resistance welding process can be performed by concentrating the current to the protrusion, and sufficient bonding strength can be attained. Moreover, an insulating ring for preventing the current from flowing through a portion other than welded portions is unnecessary.

According to another aspect of the present invention, a common rail formed by welding a first member and a second member with each other has positioning portions at a position, where the first member and the second member contact when the welding is performed, wherein the first member and the second member fit each other at the positioning portion.

By performing the welding process while fitting the positioning portions, bonding accuracy between the first and second parts can be improved.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF THE REFERRED EMBODIMENT

Figure 1:
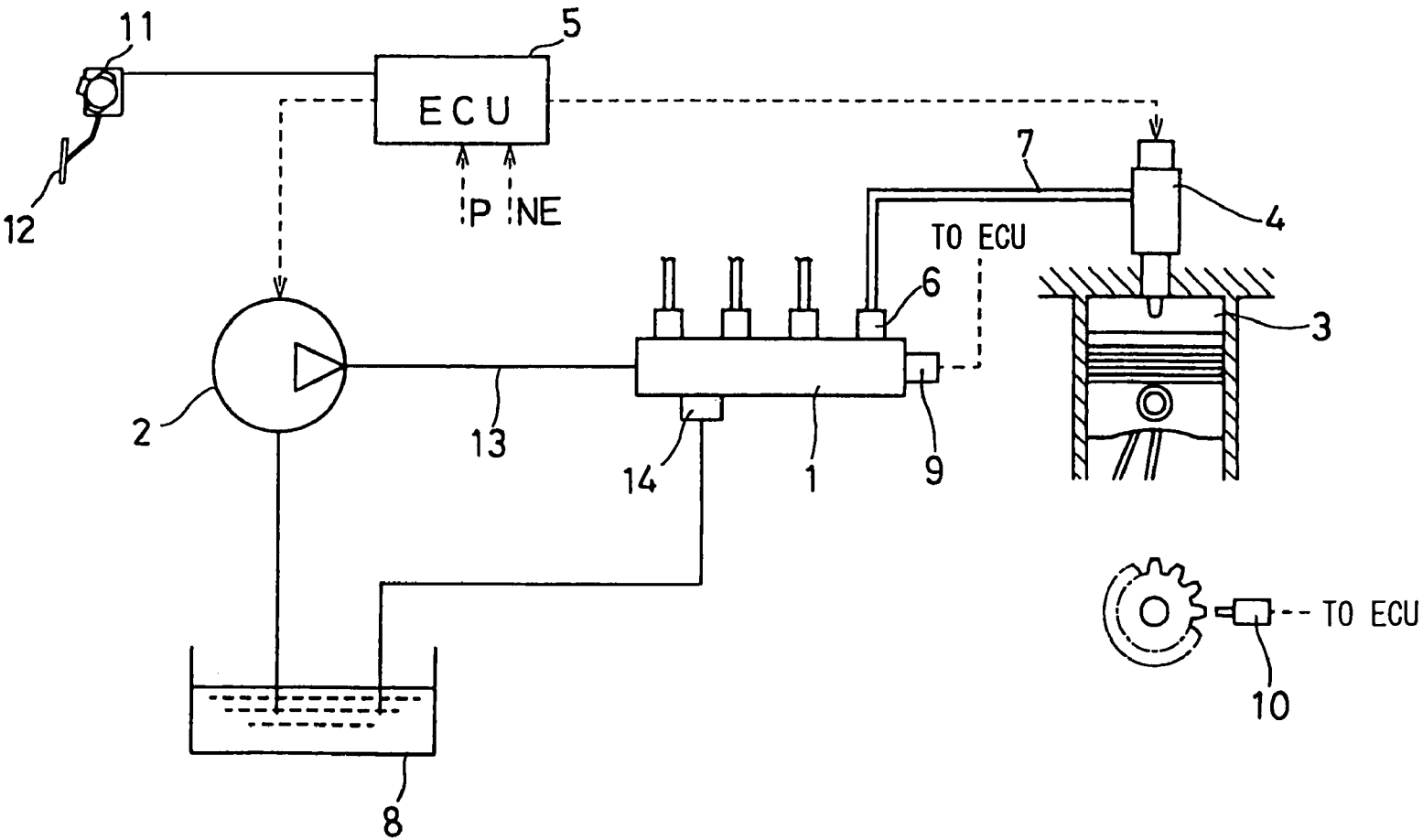
FIG. 1 is a schematic diagram showing a pressure accumulation fuel injection system according to a first example embodiment of the present invention.

Referring to FIG. 1, a pressure accumulation fuel injection system according to a first example embodiment of the present invention is illustrated.

The pressure accumulation fuel injection system according to the first embodiment is applied to a four-cylinder diesel engine, for example. As shown in FIG. 1, the fuel injection system has a common rail 1 that accumulates fuel, a fuel supply pump 2 that pressure-feeds the fuel to the common rail 1, at least one (four, in the present embodiment) injector 4 that injects the fuel into a cylinder 3 of the diesel engine, and the like. An electronic control unit (ECU) controls the fuel injection system.

The common rail 1 accumulates the fuel, which is supplied by the fuel supply pump 2, to an injection pressure (target rail pressure). The ECU 5 calculates the target rail pressure in accordance with operating states of the engine (for example, accelerator position and engine rotation speed). The common rail 1 is formed with pipe connector 6, the number of which is the same as the number (four, in the present embodiment) of the cylinders of the engine. The connector 6 is connected with a high-pressure pipe 7 for supplying the high-pressure fuel, which is accumulated in the common rail 1, to the injector 4.

The fuel supply pump 2 includes a feed pump (not shown) that draws the fuel from a fuel tank 8. The fuel supply pump 2 pressurizes the fuel drawn by the feed pump to a predetermined pressure and pressure-feeds the fuel to the common rail 1.

Each injector 4 is mounted to each cylinder of the engine and is connected to the common rail 1 through the high-pressure pipe 7. The injector 4 includes an electromagnetic valve (not shown), which is electronically controlled by the ECU 5. Injection timing and injection quantity are controlled by energizing timing and energizing period of the electromagnetic valve.

The ECU 5 receives sensor information sensed by various sensors (for example, a pressure sensor 9, an engine rotation speed sensor 10, and an accelerator position sensor 11). The ECU 5 controls the injection quantity of the injector 4 and the fuel discharge quantity of the fuel supply pump 2.

The pressure sensor 9 is mounted to an end of the common rail 1. The pressure sensor 9 senses the fuel pressure (actual rail pressure) P accumulated in the common rail 1, and outputs sensing result to the ECU 5.

The engine rotation speed sensor 10 outputs multiple pulse signals during one rotation of a crankshaft of the engine. The ECU 5 senses the engine rotation speed NE by measuring intervals among the pulse signals output by the engine rotation speed sensor 10.

The accelerator position sensor 11 senses an accelerator position based on manipulation amount (pressing amount) of an accelerator pedal 12 operated by a vehicle driver. The accelerator position sensor 11 outputs sensing result to the ECU 5.

Figure 2:
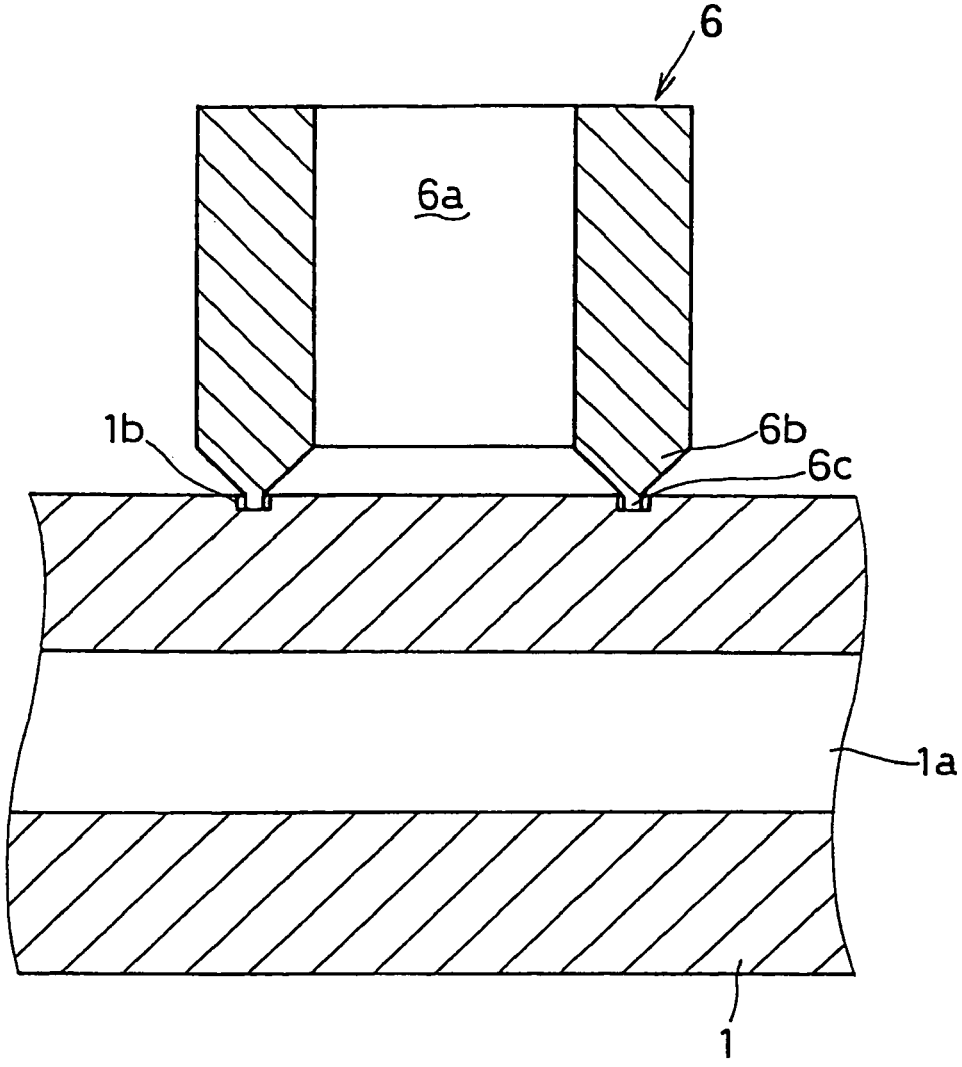
FIG. 2 is a sectional view showing a connecting structure of a common rail and a connector according to the FIG. 1 embodiment.

The connector 6 is bonded to a predetermined portion of the common rail 1 through resistance welding process. As shown in FIG. 2, the connector 6 is formed in the shape of a ring-like body having a bore 6*a*. An end of the high-pressure pipe 7 is inserted into the bore 6*a* and is bonded by a nut or the like (not shown).

The connector 6 is formed with an annular connecting portion 6*b* on a seat surface side (side opposite from a side into which the high-pressure pipe 7 is inserted). The connecting portion 6*b* is tapered so that the thickness thereof gradually decreases toward the tip end thereof. The connecting portion 6*b* is formed with a protrusion 6*c* on the tip end thereof. In an example embodiment, a section of the protrusion 6*c* is formed in a rectangular shape as shown in FIG. 2, although other protrusion shapes may be provided as noted below. The protrusion 6*c* is formed in the shape of a ring along a circumference of the connecting portion 6*b*. In an example embodiment, the protrusion 6*c* is continuous and is defined about an entire circumference of the connecting portion 6*b*. It is to be understood, however, that a discontinuous protrusion may be an option.

Figure 3:
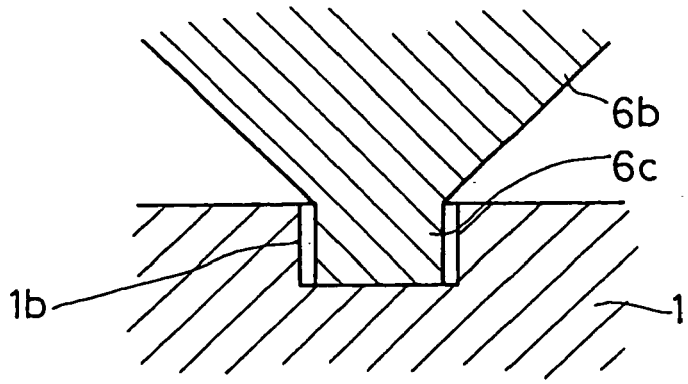
FIG. 3 is an enlarged sectional view showing the connecting structure according to the FIG. 1 embodiment.

The common rail 1 is formed with a bore 1*a*, the cross-section of which is, e.g., round, at the axial center thereof along longitudinal direction. Both ends of the round bore 1*a* are hermetically blocked to form an accumulation chamber for accumulating the high-pressure fuel. A part of circumference of the outer peripheral surface of the common rail 1 is flattened along the longitudinal direction. A ring-shaped groove 1*b* having a section, rectangular in this example embodiment, is formed in the flattened face. The depth of the groove 1*b* is substantially the same as the height of the protrusion 6*c*, and the width (horizontal dimension in FIG. 3) of the groove 1*b* is slightly larger than that of the protrusion 6*c*, as shown in FIG. 3.

By fitting the protrusion 6*c* into the ring-shaped groove 1*b* formed on the common rail 1, both surfaces (inner and outer peripheral surfaces) of the protrusion 6*c* are restricted by both sides of the groove 1*b*. Thus, the connector 6 is positioned. A resistance welding process is performed while applying a pressing force to the positioned connector 6 to bond the connector 6 to the common rail 1.

In this bonding method, since the positioning portions (the groove 1*b* and the protrusion 6*c*) are formed on the common rail 1 and the connector 6, high positional accuracy can be attained. Since the thickness of the connecting portion 6*b* formed on the connector 6 is gradually reduced toward the tip end and the protrusion 6*c* is formed on the tip end of the connecting portion 6*b*, current is converged to the protrusion 6*c* to increase density of the current. Thus, sufficient bonding strength can be attained. Moreover, since the current is converged to the protrusion 6*c*, an insulating ring is unnecessary.

The bonding method according to the present embodiment does not ensure the positional accuracy of the connector 6 with respect to the common rail 1 by performing jig adjustment. Therefore, even if thermal expansion of the common rail 1 is caused by heat generation when the resistance welding process is performed, the positional accuracy of the connector 6 with respect to the common rail 1 can be ensured without being affected by the thermal expansion. More specifically, the connector 6 is positioned to the predetermined position even if the common rail has thermally expanded. Thus, influence of the thermal expansion of the common rail 1 over the positional accuracy of the connector 6 and deterioration of the positional accuracy of the connector 6 can be prevented.

Figure 4:
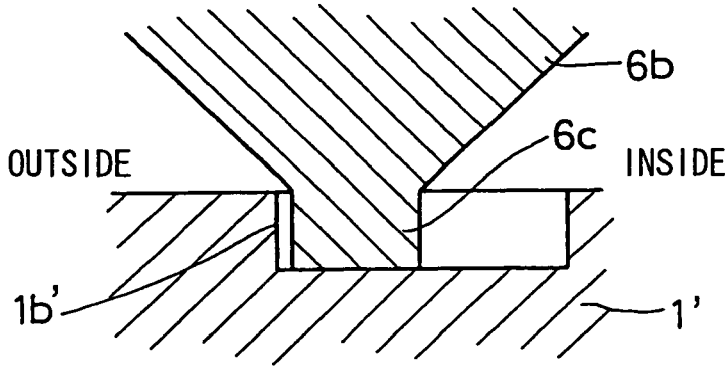
FIGS. 4-17 are enlarged sectional views showing connecting structures of modified examples of the FIG. 1 embodiment.
Figure 5:
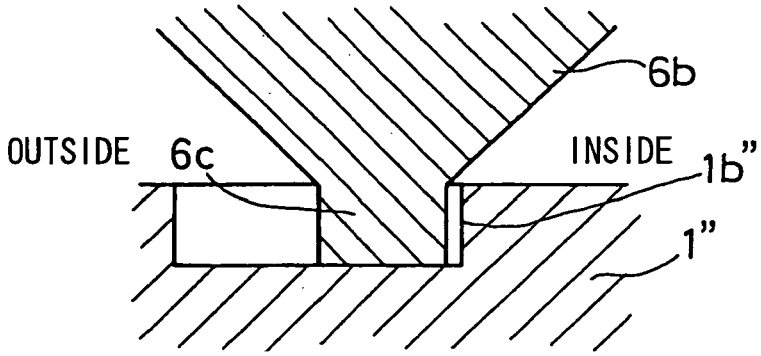
Figure 6:
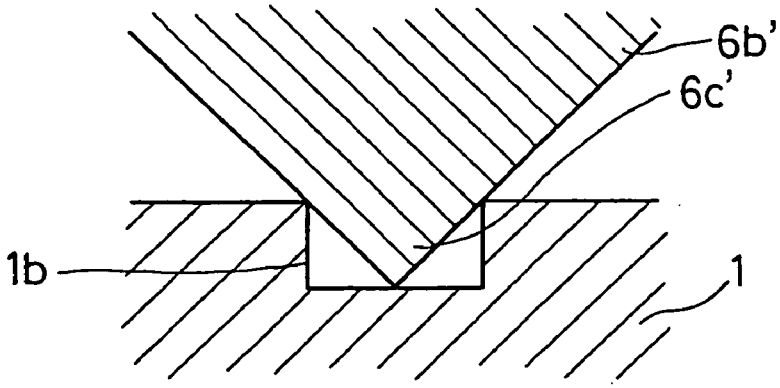
Figure 7:
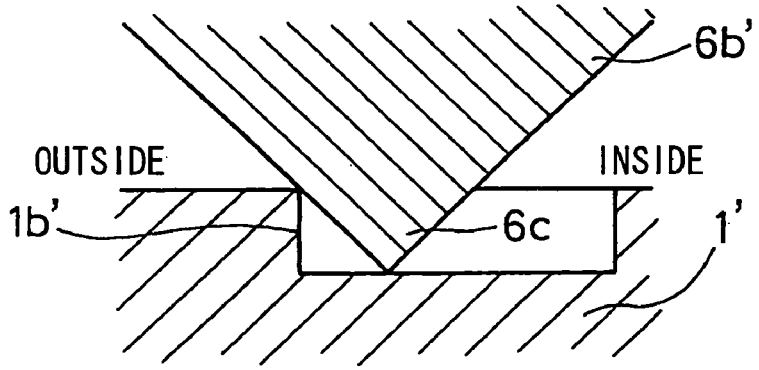
Figure 8:
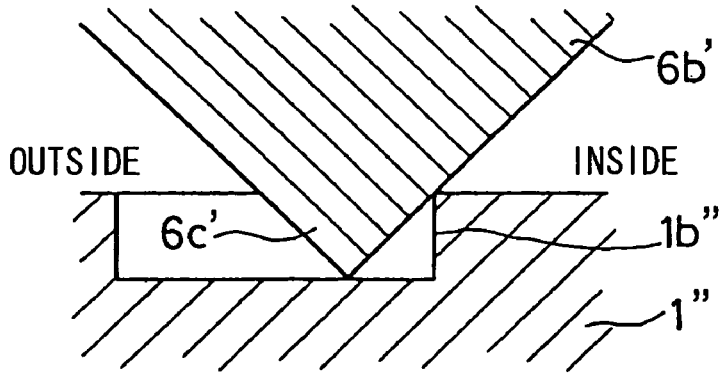
Figure 9:
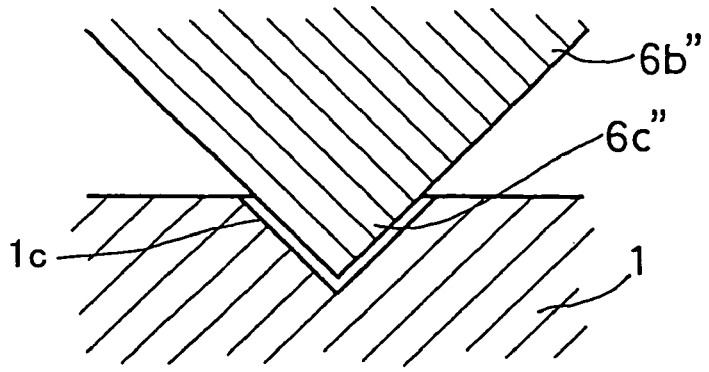
Figure 10:
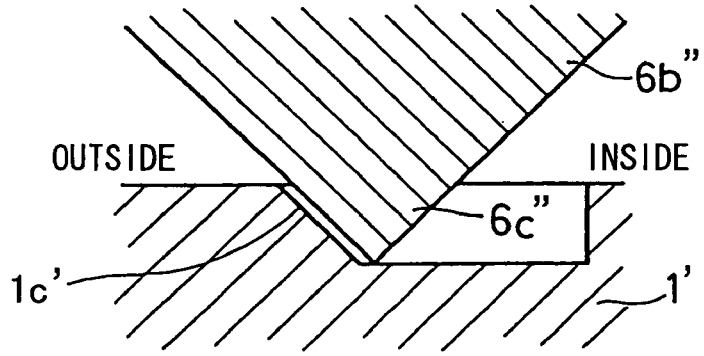
Figure 11:
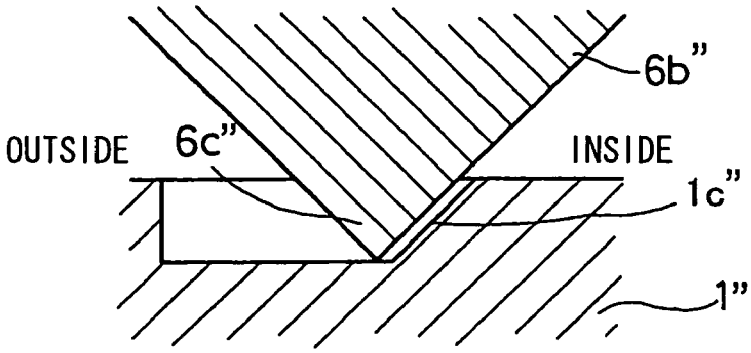
Figure 12:
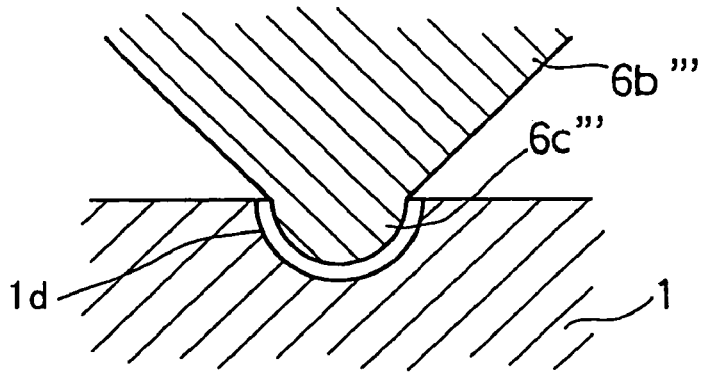
Figure 13:
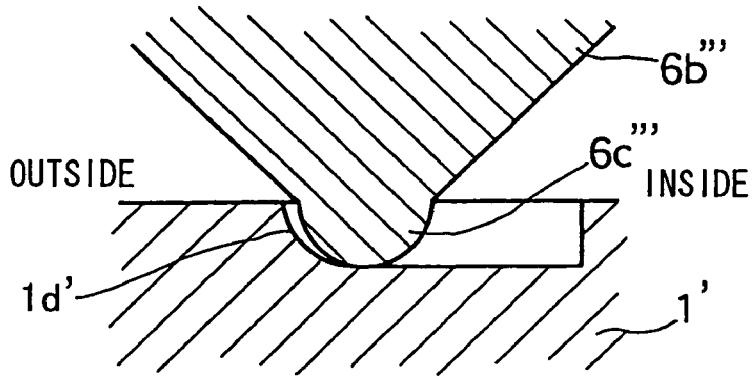
Figure 14:
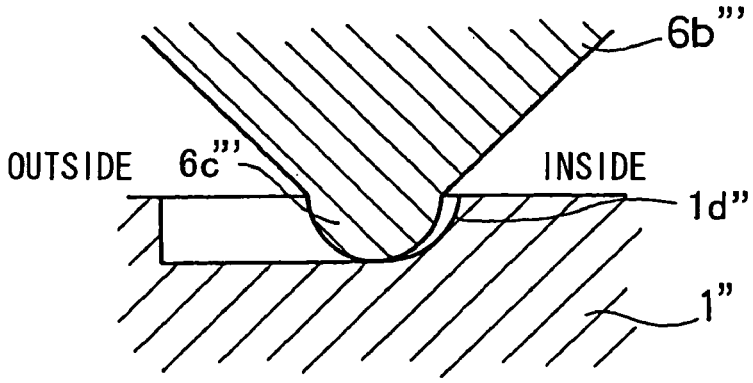
Figure 15:
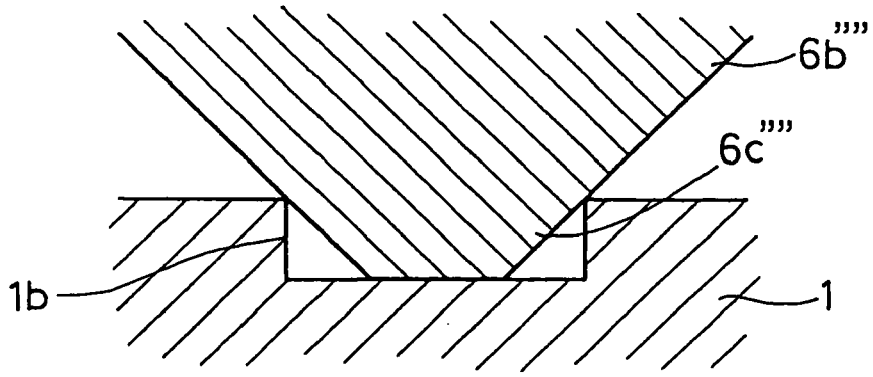
Figure 16:
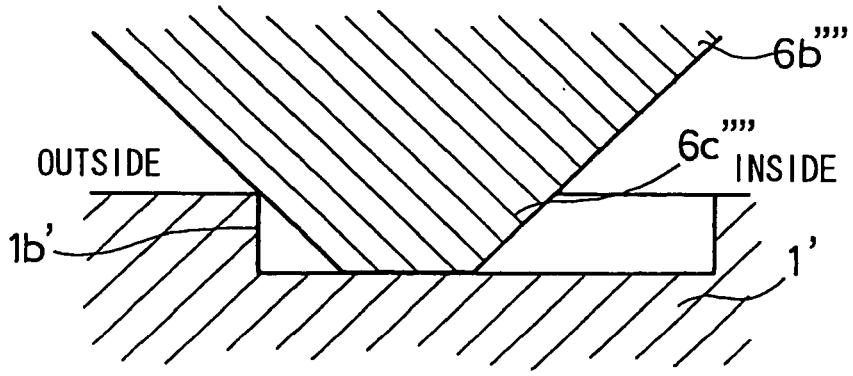
Figure 17:
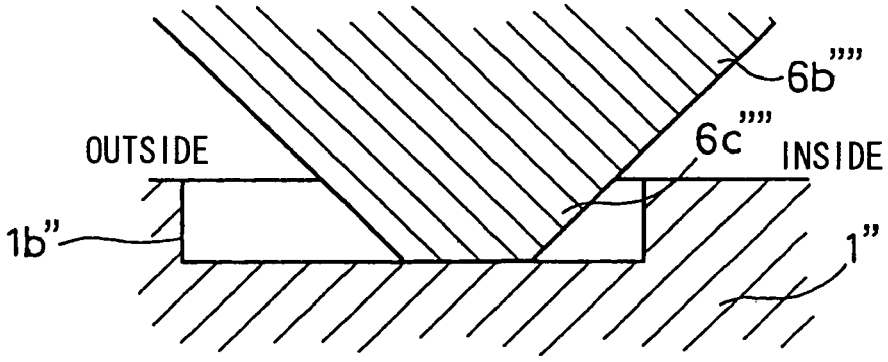

In the first example embodiment, both sides of the protrusion 6*c* formed on the connector 6 are restricted and positioned by both sides of the groove 1*b* formed on the common rail 1 (the width of the groove 1*b* is slightly larger than the width of the protrusion 6*c*). Alternatively, the outer peripheral surface of the protrusion 6*c* may be positioned by the outer peripheral surface of the groove 1*b*' as shown in FIG. 4, or the inner peripheral surface of the protrusion 6*c* may be positioned by the inner peripheral surface of the groove 1*b*" as shown in FIG. 5.

In the first example embodiment, the connecting portion 6*b* of the connector 6 is tapered, and the protrusion 6*c* having the rectangular section is provided on the tip end of the connecting portion 6*b*. The shape of the protrusion 6*c* may be changed arbitrally as shown by way of example in FIGS. 6 to 17. The shape of the section of the groove 1*b*, 1*c*, 1*d* may be changed in accordance with the shape of the protrusion 6*c*.

In the first embodiment, the present invention is applied to the connector 6 for connecting the high-pressure pipe 7 to the common rail 1. The invention can also be applied to a pipe connector for connecting a fuel pipe 13, which is used for supplying the high-pressure fuel pressured-fed by the fuel supply pump 2 to the common rail 1, to the common rail 1, a connector for connecting the pressure sensor 9, a pressure reduction valve 14 or a pressure regulator (not shown) to the common rail 1, a fixing connector for fixing a bracket to the common rail 1, a pipe connector for connecting the fuel pipe 13 to a cylinder head of the fuel supply pump 2, or a pipe connector for connecting the high-pressure pipe 7 to a body of the injector 4, for example.

Figure 18:
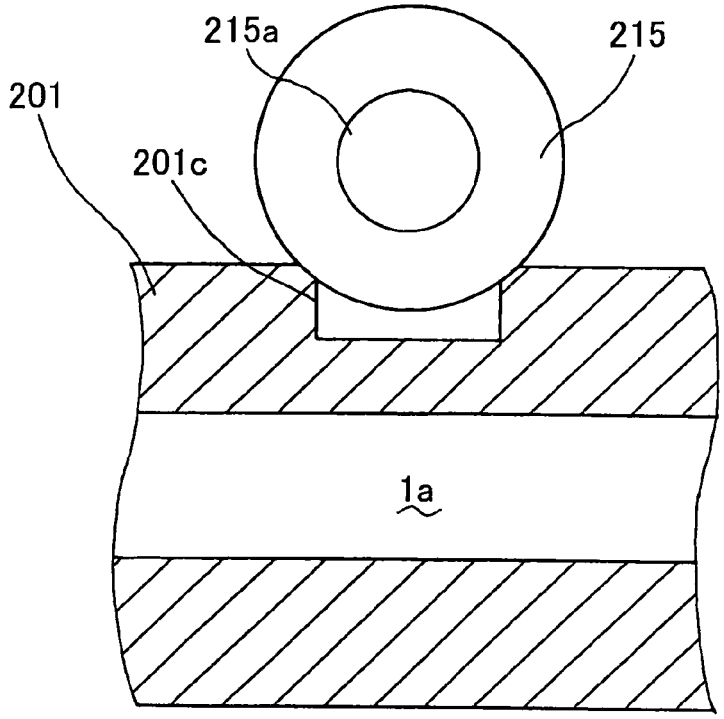
FIG. 18 is a sectional view showing a connecting structure between a common rail and a mounting stay according to an example embodiment of the present invention.

A common rail 1 according to an example embodiment of the present invention is illustrated in FIG. 18. Two mounting stays 215 are bonded to the common rail 201 shown in FIG. 18 through a resistance welding process. The common rail 201 is mounted to the diesel engine through the mounting stays 215 by screwing bolts (not shown).

The mounting stay 215 is formed in a cylindrical shape having a round hole 215*a*, through which the bolt is inserted. The center of the inner periphery of the round hole 215*a* and the center of the outer periphery of the mounting stay 215 coincide with each other. More specifically, the inner peripheral circle of the mounting stay 215 (periphery of the round hole 215*a*) and the outer peripheral circle of the mounting stay 215 are provided as concentric circles. The mounting stay 215 is bonded to the common rail 201 so that the direction of the axial center of the round hole 215*a* is perpendicular to the longitudinal direction of the common rail 201.

Figure 19:
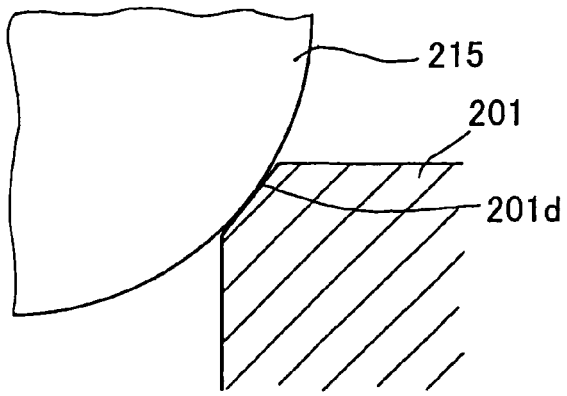
FIG. 19 is an enlarged view showing a part of the connecting structure according to the FIG. 18 embodiment.
Figure 20:
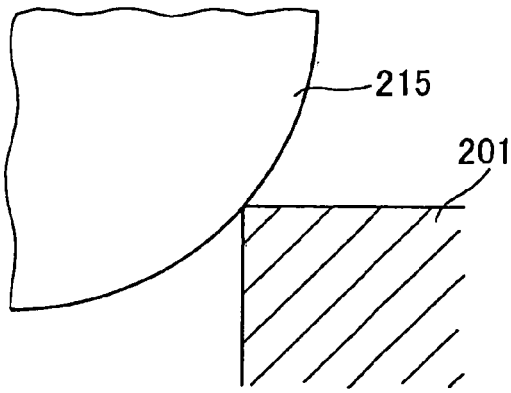
FIG. 20 is an enlarged view showing a modified part of the connecting structure according to the FIG. 18 embodiment.

The common rail 201 is formed with two positioning cavities 201*c* for positioning the mounting stays 215. The positioning cavity 201*c* is formed in a rectangular shape with a predetermined width along the longitudinal direction of the common rail 201. The width of the positioning cavity 201*c* is set smaller than the external diameter of the mounting stay 215. The depth of the positioning cavity 201*c* is set so that the outer peripheral surface of the mounting stay 215 does not hit the bottom of the positioning cavity 201*c* when the mounting stay 215 is put on both edges of the positioning cavity 201*c*. The edge of the positioning cavity 215 may be chamfered to form a chamfered portion 201*d* as shown in FIG. 19, or the edge may be maintained as shown in FIG. 20.

In the structure according to this example embodiment, the center of the mounting stay 215 can be aligned with the center of the positioning cavity 201*c* by putting the outer peripheral surface of the mounting stay 215 on both edges of the positioning cavity 201*c*. More specifically, the mounting stay 215 is positioned to the predetermined position with respect to the common rail 201 through self-centering. Thus, even in the case where an error is caused in the length of the common rail 201 or the external diameter of the mounting stay 215, the mounting stay 215 can be positioned in a predetermined position with respect to the common rail 201 without being affected by the error. Therefore, the positional accuracy can be improved.

The scheme according to this example embodiment does not ensure the positional accuracy of the mounting stay 215 with respect to the common rail 201 by performing jig adjustment. Therefore, even if thermal expansion of the common rail 201 is caused by heat generation when the resistance welding process is performed, the positioning can be performed while absorbing the thermal expansion. More specifically, even if the common rail 201 is lengthened due to the thermal expansion, the center of the mounting stay 215 can be kept at the center of the positioning cavity 201*c*. Therefore, the bonding position of the mounting stay 215 is not deviated by the thermal expansion of the common rail 201. As a result, the positional accuracy of the mounting stay 215 with respect to the common rail 201 can be ensured.

Figure 21B:
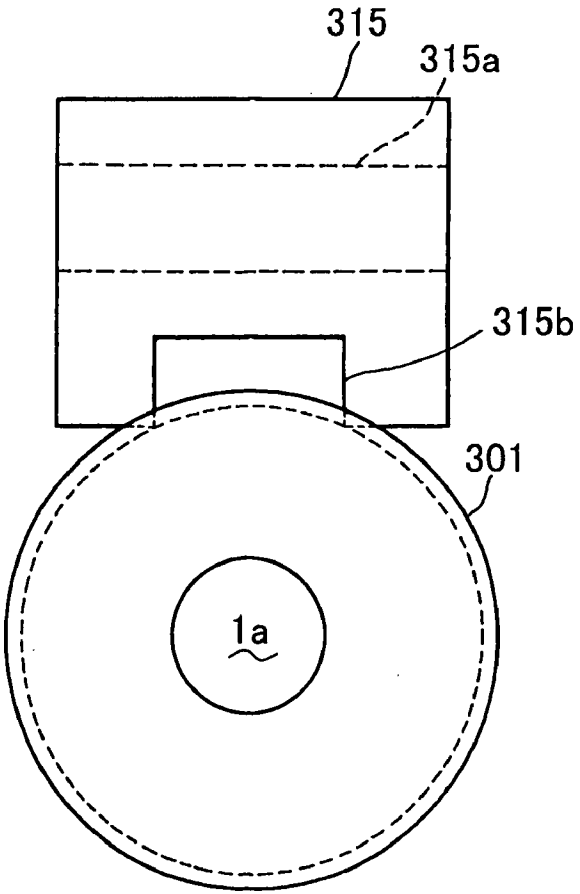
FIG. 21B is an axial front view showing the connecting structure according to the FIG. 21A embodiment.
Figure 21A:
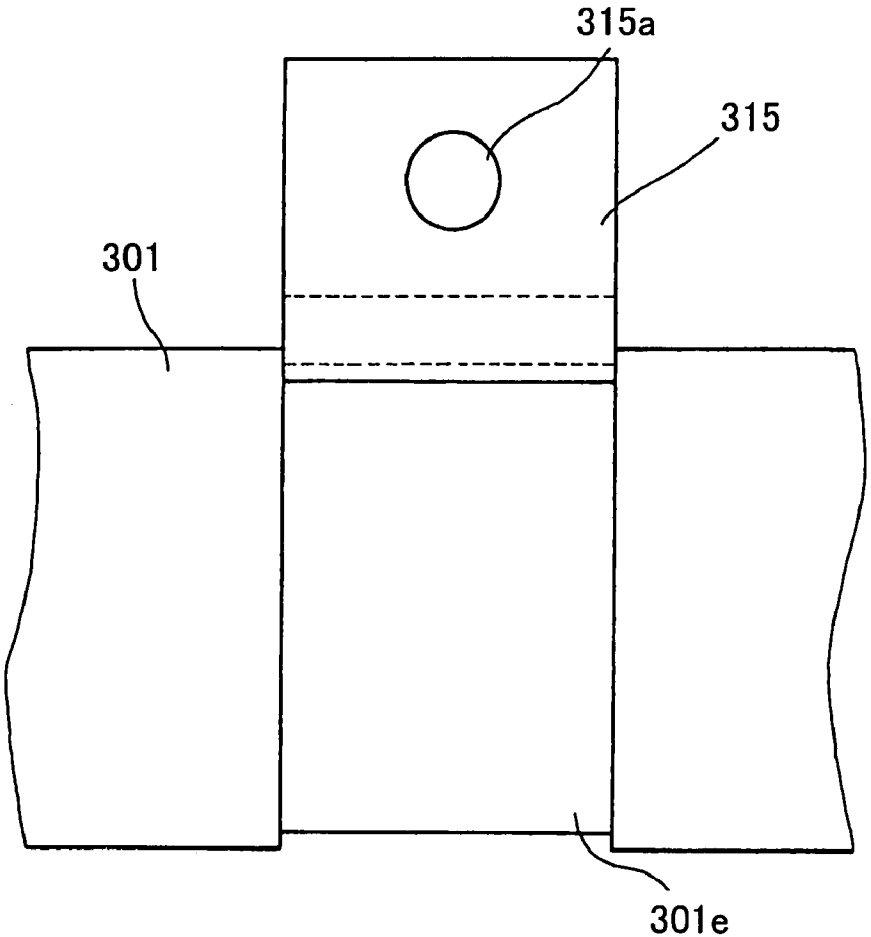
FIG. 21A is a side view showing a connecting structure between a common rail and a mounting stay according to another example embodiment of the present invention.

A common rail 301 according to an example embodiment of the present invention is illustrated in FIGS. 21A and 21B.

Figure 22:
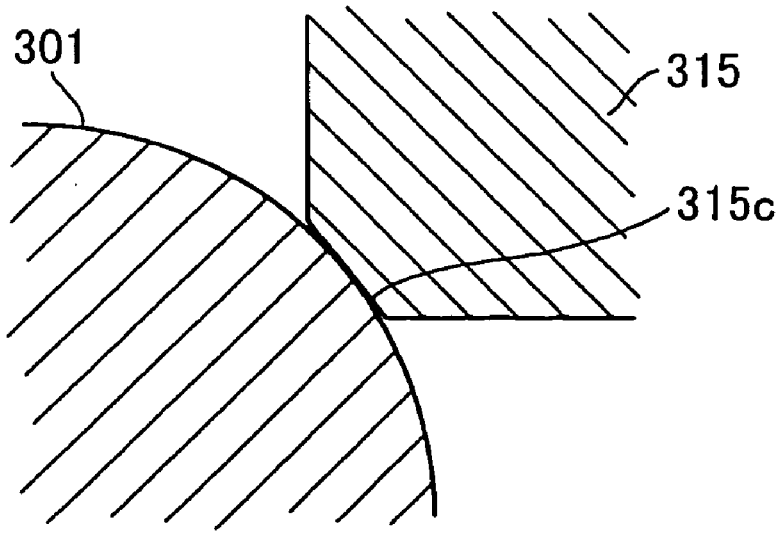
FIG. 22 is an enlarged sectional view showing a part of the connecting structure according to the FIG. 21A embodiment.
Figure 23:
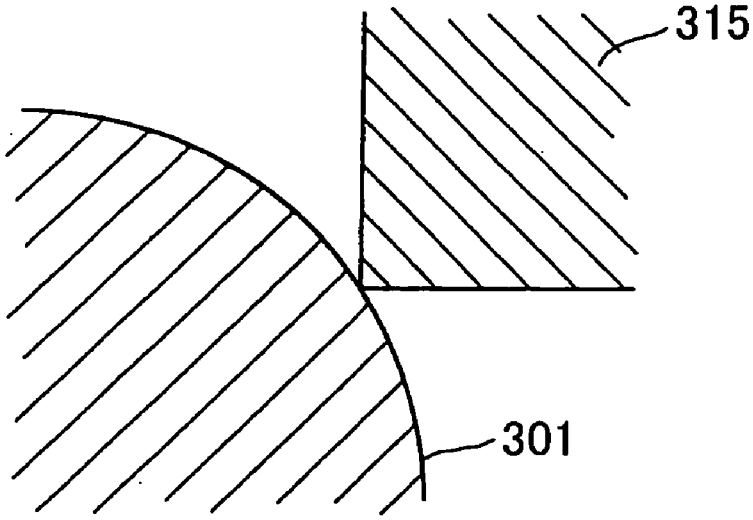
FIG. 23 is an enlarged sectional view showing a part of the connecting structure according to the FIG. 21A embodiment.

The common rail 301 shown in FIGS. 21A and 21B uses a cube-shaped mounting stay 315. A profile of the mounting stay 315 according to this example embodiment is formed in the shape of a cube as shown in FIGS. 21A and 21B. A positioning cavity 315*b* is formed on a surface of the cubic shape of the mounting stay 315. The mounting stay 315 is formed with a through hole 315*a*, and the positioning cavity 315*b* is formed in a rectangular shape with a predetermined width along the direction of the axial center of the through hole 315*a*. An edge of the mounting stay 315 may be chamfered to form a chamfered portion 315*c* as shown in FIG. 22, or the edge of the mounting stay 315 may be maintained as shown in FIG. 23.

The common rail 301 is formed with a positioning groove 301*e* for positioning the mounting stay 315 with respect to the longitudinal direction of the common rail 301 as shown in FIG. 21A. The length of the positioning groove 301*e* along the longitudinal direction of the common rail 301 is set so that the width of the mounting stay 315 just fits into the positioning groove 301*e*. The positioning groove 301*e* is formed along the circumference of the common rail 301, along the entire circumference in the illustrated example.

The positioning of the mounting stay 315 with respect to the longitudinal direction of the common rail 301 can be performed by fitting the mounting stay 315 into the positioning groove 301*e*. The center of the positioning cavity 315*b* is aligned with the center of the common rail 301 by putting (contacting) both edges of the positioning cavity 315*b* onto the outer peripheral surface of the common rail 301 (positioning groove 301*e*). More specifically, the positional accuracy of the mounting stay 315 with respect to a direction (lateral direction in FIG. 21B) perpendicular to radial direction can be ensured through self-centering.

Figure 24B:
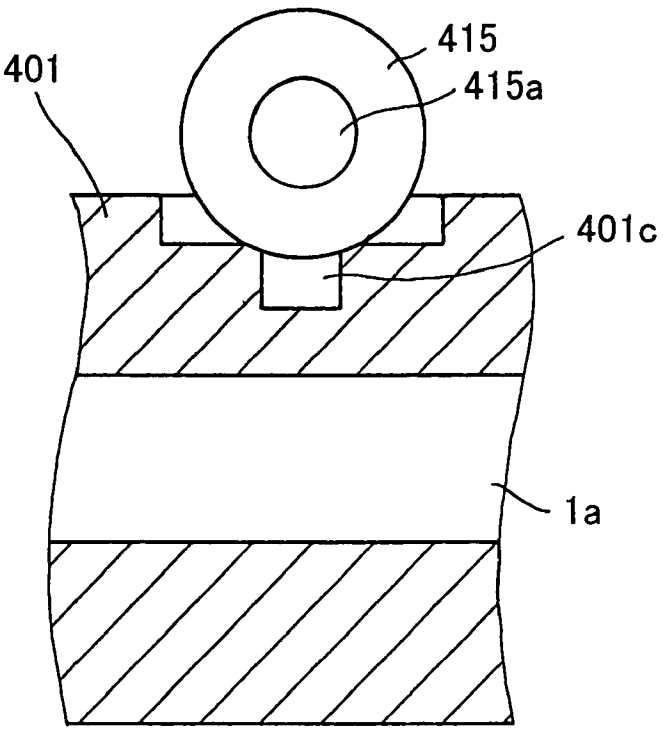
FIG. 24B is a sectional view showing the connecting structure according to the FIG. 24A embodiment.
Figure 24A:
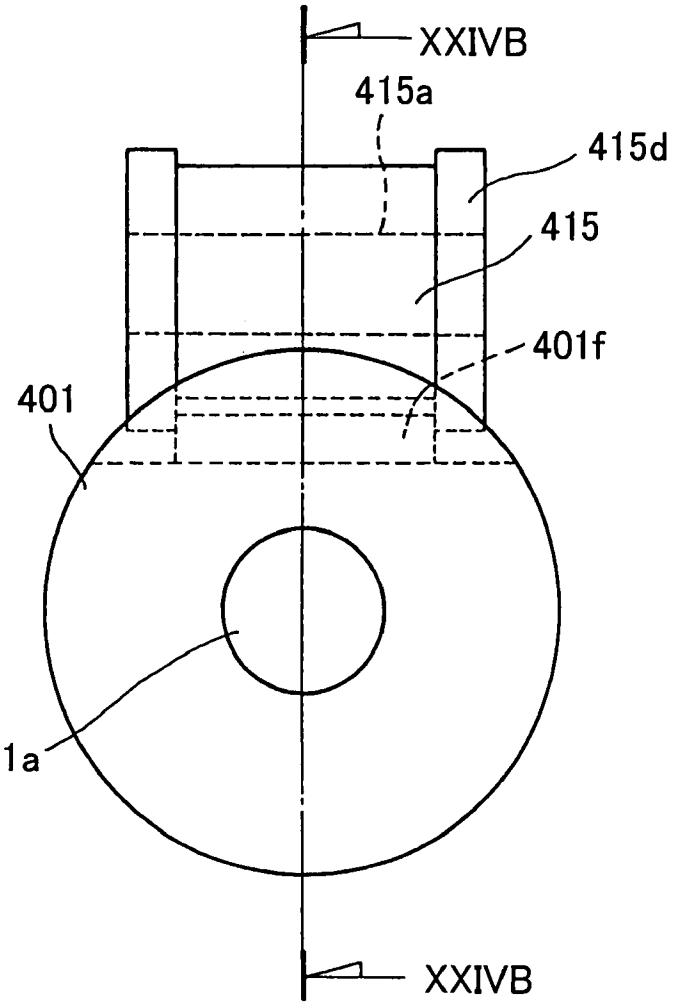
FIG. 24A is an axial front view showing a connecting structure between a common rail and a mounting stay according to yet another example embodiment of the present invention.

A common rail 401 according to an example embodiment of the present invention is illustrated in FIGS. 24A and 24B.

A mounting stay 415 according to this example embodiment is formed in the shape of a cylinder with flange portions 415*d* at both ends of the cylindrical shape. An external diameter of the flange portion 415*d* is slightly larger than the external diameter of the cylindrical portion. The mounting stay 415 is formed with a through hole 415*a*.

The common rail 401 is formed with a positioning portion 401*f* having a length that can just fit between both flange portions 415*d* of the mounting stay 415. The positioning portion 401*f* is formed by chiseling the outer peripheral surface of the common rail 401 stepwise. The positioning portion 401*f* also functions as a positioning cavity 401*c* for positioning the mounting stay 415 with respect to the longitudinal direction of the common rail 401.

In the structure according to this example embodiment, the positioning of the mounting stay 415 with respect to the longitudinal direction of the common rail 401 can be performed by putting the outer peripheral surface of the cylindrical portion of the mounting stay 415 onto both edges of the positioning cavity 401*c*. The movement of the mounting stay 415 along the central axis of the mounting stay 415 (lateral direction in FIG. 24A) can be restricted by fitting the positioning portion if between both flange portions 415*d* of the mounting stay 415.

Even if the thermal expansion of the common rail 401 caused by heat generation when the resistance welding process is performed, the positional accuracy of the mounting stay 415 with respect to the common rail 401 can be ensured without being affected by the thermal expansion also in the third and fourth embodiments, like the second embodiment.

Figure 25:
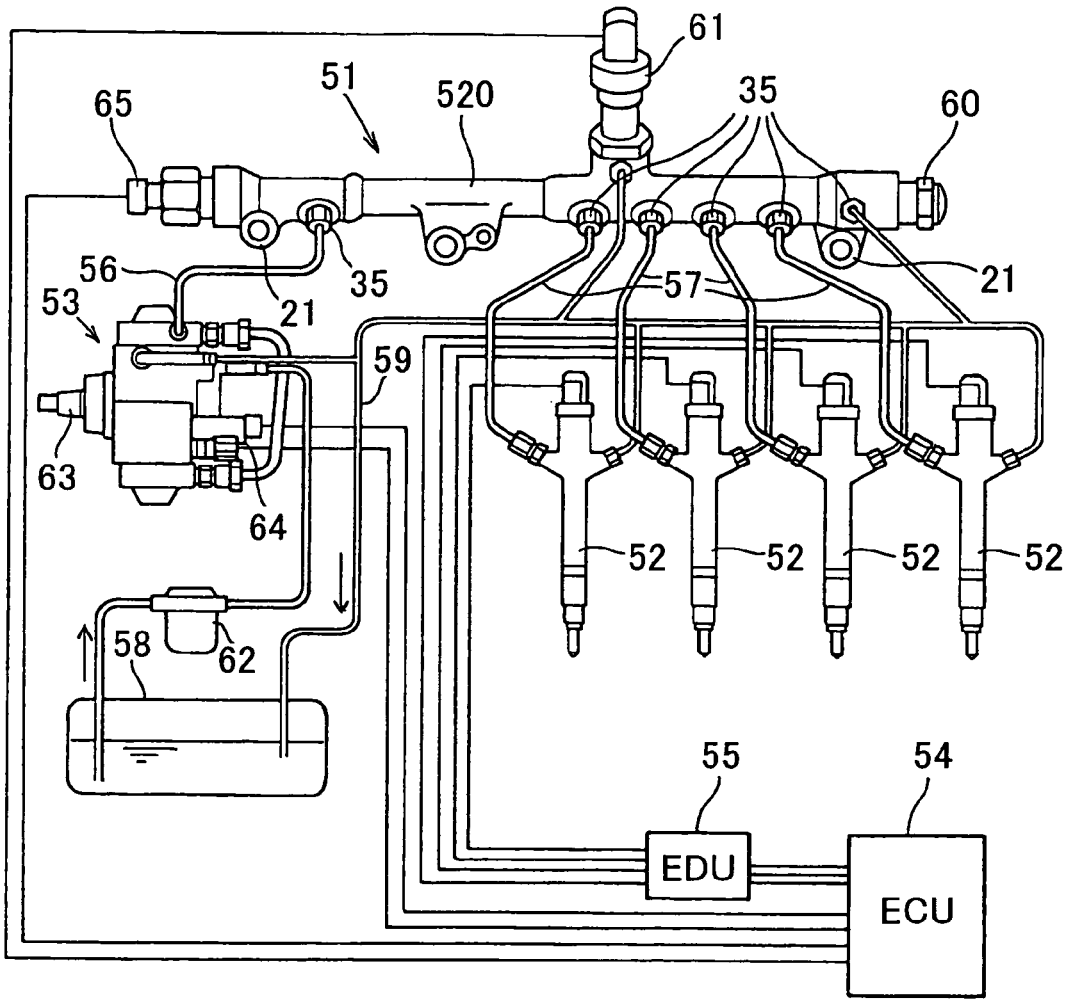
FIG. 25 is a schematic diagram showing a common rail fuel injection system according to an example embodiment of the present invention.

A common rail type fuel injection system according to an example embodiment of the present invention is illustrated in FIG. 25. The fuel injection system shown in FIG. 25 performs fuel injection into respective cylinders of an engine (for example, a diesel engine, not shown). The fuel injection system includes a common rail 51, injectors 52, a supply pump 53, an engine control unit (ECU) 54, engine drive unit (EDU) 55, and the like. The EDU 55 may be integrated in the ECU 54.

The common rail 51 is an accumulation vessel for accumulating high-pressure fuel, which is to be supplied to the injectors 52. In order to accumulate a common rail pressure in the common rail 51 in accordance with fuel injection pressure, the common rail 51 is connected with a discharge port of the supply pump 53, which pressure-feeds the high-pressure fuel, through a high-pressure pump pipe 56. The common rail 51 is connected with multiple injector pipes 57 for supplying the high-pressure fuel to the injectors 52.

A pressure limiter 60 as a pressure safety valve is attached to a relief pipe 59 that returns the fuel from the common rail 51 to a fuel tank 58. The pressure limiter 60 opens if the fuel injection pressure inside the common rail 51 exceeds a limit set pressure in order to limit the fuel injection pressure inside the common rail 51 to the limit set pressure or under.

Figure 26:
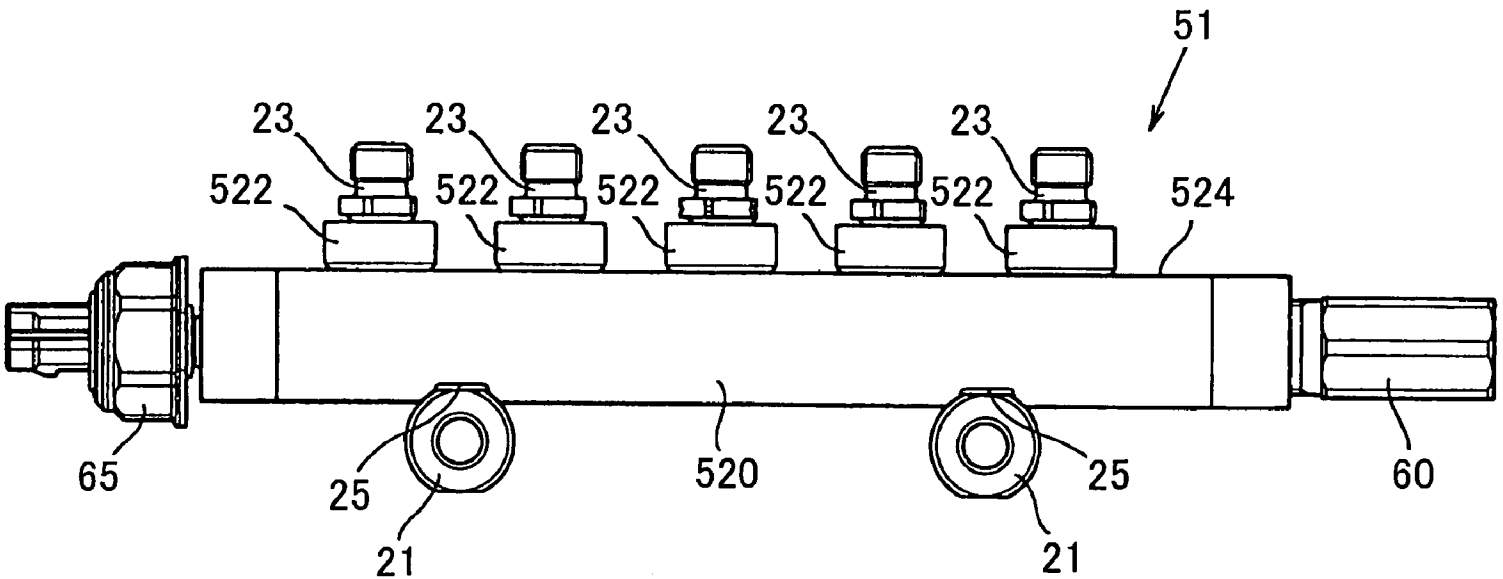
FIG. 26 is a side view showing a common rail according to the FIG. 25 embodiment.

A pressure reduction valve 61 is attached to the common rail 51. The pressure reduction valve 61 opens responsive to a valve opening command signal provided by the ECU 54. Thus, the pressure reduction valve 61 quickly reduces the common rail pressure through the relief pipe 59. By mounting the pressure reduction valve 61 to the common rail 51, the ECU 54 can quickly control the common rail pressure down to a pressure corresponding to a running condition of a vehicle. Alternatively, the pressure reduction valve 61 may not be mounted to the common rail 51 as shown in FIG. 26.

The injector 52 is mounted to each cylinder of the engine to inject the fuel into the cylinder. The injector 52 includes a fuel injection nozzle, an electromagnetic valve and the like. The fuel injection nozzle is connected to a downstream end of each one of the injector pipes 57 branching from the common rail 51 and injects the high-pressure fuel accumulated in the common rail 51 into each cylinder. The electromagnetic valve controls lifting operation of a needle accommodated in the fuel injection nozzle.

Leak fuel from the injector 52 is returned to the fuel tank 58 through the relief pipe 59.

The supply pump 53 is a high-pressure fuel pump for pressure-feeding the high-pressure fuel to the common rail 51. The supply pump 53 has a feed pump that draws the fuel from the fuel tank 58 to the supply pump 53 through a filter 62. The supply pump 53 pressurizes the drawn fuel to high pressure and pressure-feeds the pressurized fuel to the common rail 51. The feed pump and the supply pump 53 are driven by a common camshaft 63, which is rotated by the engine.

A suction control valve (SCV) 64 is mounted to a fuel passage of the supply pump 53 that leads the fuel into a pressurizing chamber pressurizing the fuel to high pressure. The SCV 64 regulates an opening degree of the fuel passage. The SCV 64 is controlled by a pump drive signal provided by the ECU 54 to regulate a suction quantity of the fuel suctioned into the pressurizing chamber. Thus, the SCV 64 changes the discharge quantity of the fuel pressure-fed to the common rail 51. The common rail pressure is regulated by regulating the quantity of the fuel discharged into the common rail 51. More specifically, the ECU 54 controls the SCV 64 to control the common rail pressure to a pressure corresponding to the running state of the vehicle.

The ECU 54 includes a CPU and a memory device (a memory such as ROM, RAM, SRAM, or EEPROM). The ECU 54 performs various types of calculation processing based on programs stored in the ROM and sensor signals (operating state of the vehicle) input to the RAM and the like.

Every time the fuel injection is performed, the ECU 54 determines target injection quantity, an injection mode, opening and closing timing of the injector 52 and an opening degree of the SCV 64 (energizing current value) of each injection based on the programs stored in the ROM and the sensor signals input to the RAM.

The EDU 55 has an injector drive circuit.

The injector drive circuit provides a valve opening drive current to the electromagnetic valve of the injector 52 based on an injector opening signal provided by the ECU 54. By providing the valve opening drive current to the electromagnetic valve, the high-pressure fuel is injected into the cylinder. By stopping the valve opening drive current, the fuel injection is stopped. An SCV drive circuit for providing a drive current to the electromagnetic valve of the SCV 64 may be housed in a casing of the ECU 54. Alternatively, the SCV drive circuit may be housed in a casing of the EDU 55.

The ECU 54 is connected with sensors for sensing the operating states of the vehicle such as a pressure sensor 65 for sensing the common rail pressure, an accelerator sensor for sensing an accelerator position, a rotation speed sensor for sensing engine rotation speed, and a water temperature sensor for sensing temperature of cooling water of the engine.

A rail main body 520, a stay 21, and a pipe connecting portion of the common rail 51, e.g., according to this example embodiment, are prepared separately and are bonded with each other through welding process or fastening process to form the common rail 51. The rail main body 520 accumulates the high-pressure fuel within. The stay 21 is used to attach the rail main body 520 to a fixing member of the engine or the like. The stay 21 may have a configuration and be attached to the rail main body in a manner as described above. The pipe connecting portion includes a connector 522 and a joint 23. The pipe connecting portion is used to connect the high-pressure pump pipe 56 or the injector pipe 57.

The rail main body 520 is made of a metal material of iron family. A profile of the rail main body 520 is formed substantially in the shape of a cylindrical column.

An accumulation chamber for accumulating the high-pressure fuel is formed inside the rail main body 520 so that the accumulation chamber penetrates the rail main body 520 in the axial direction. An axial center of the accumulation chamber may be offset with respect to the center of the rail main body 520 or may coincide with the center of the rail main body 520.

Threaded holes are formed in both ends of the rail main body 520 for mounting the pressure limiter 60 and the pressure sensor 65.

A first flat surface 524, to which the connector 522 is bonded, is formed on an upper surface of the rail body 520 in FIG. 26 along a longitudinal direction.

A bonding groove 25, to which the stay 21 is bonded, is formed on a lower surface of the rail main body 520 in FIG. 26 perpendicularly to the longitudinal direction of the rail main body 520.

The rail main body 520 is formed with an inside-outside communication hole 526 extending in a radial direction for communicating the accumulation chamber with the outside. The inside-outside communication hole 526 communicates with each one of the pipes 56, 57. The inside-outside communication holes 526 are formed at suitable intervals with respect to the axial direction of the rail main body 520. An outside opening of each inside-outside communication hole 526 opens substantially at the center of the first flat surface 524.

The pipe connecting portion includes the connector 522, which is firmly fixed to the rail main body through the welding process, and the joint 23, which is screwed into the connector 522 and fixed to the rail main body 520.

The connector 522 is made of a metal material of iron family. A profile of the connector 522 is formed substantially in the shape of a cylinder. The connector 522 is welded to the rail main body 520, and then, the joint 23 is screwed into the connector 522. Thus, the joint 23 is fixed to the rail main body 520. A connector thread (female thread, in the present embodiment) 527 is formed on an inner peripheral surface of the connector 522.

The connector 522 is bonded to the first flat surface 524 of the rail main body 520 through electric resistance welding process at a position where the cylinder center of the connector 522 coincides with the opening center of the inside-outside communication passage 526.

The joint 23 is made of a metal material of the iron family. A profile of the joint 23 is formed substantially in the shape of a cylindrical column. A joint passage 28 is formed at the axial center of the joint 23.

A main body side male thread 29 is formed on an end of the joint 23. The main body side male thread 29 is screwed into the connector thread 527. A pipe side male thread 30 is formed on the other end of the joint 23. A jig fitting portion (hexagonal portion) 23*a* is formed between the main body side male thread 29 and the pipe side male thread 30.

A second flat surface 31 is formed on an end surface of the joint 23, on which the main body side male thread 29 is formed. The second flat surface 31 coincides with the first flat surface 524 of the rail main body 520. More specifically, the second flat surface 31 is formed on the end surface of the main body side male thread 29 to surround the joint passage 28.

The main body side male thread 29 is screwed into the connector thread 527, and the tip end of the main body side male thread 29 is pushed deeply into the connector 522. Thus, the joint passage 28 opening in the second flat surface 31 communicates with the inside-outside communication hole 526 opening in the first flat surface 524, and the second flat surface 31 around the joint passage 28 is pressed against the first flat surface 524 around the inside-outside communication hole 526 to form a main body sealing surface (oil-tight surface) 532.

The common rail 51 according to this example embodiment employs the structure in which the connector 522 is welded onto the first flat surface 524 of the rail main body 520.

If the connector is just put onto the first flat surface of the rail main body and welded, the connector can easily move on the first flat surface. Accordingly, the welding accuracy of the connector can be affected by the shape accuracy of a welding jig. Therefore, it may be difficult to weld the connector to the rail main body with high accuracy.

Therefore, in this example embodiment of the invention, a positioning portion 540 is formed at a position where the rail main body 520 and the connector 522 contact each other during the welding process so that the rail main body 520 and the connector 522 are fit with each other at the positioning portion 540.

The rail main body 520 and the connector 522 are fit with each other at the positioning portion 540 before the welding process is performed. The positioning portion 540 of this example embodiment is provided by a cavity (positioning groove) 541 formed on the first flat surface 524 of the rail main body 520 and a protrusion (positioning claw) 542 formed on a tip end of the connector 522. The rail main body 520 and the connector 522 are positioned by fitting the protrusion 542 into the cavity 541.

The protrusion 542 is shaped in an annular shape, in this example continuously along the tip end of the connector 522. The cavity 541 is a continuous annular groove, the diameter of which, in this example, is the same as that of the protrusion 542 of the connector 522. The cavity 541 is formed coaxially with the outside opening of the inside-outside communication hole 526.

Figure 27A:
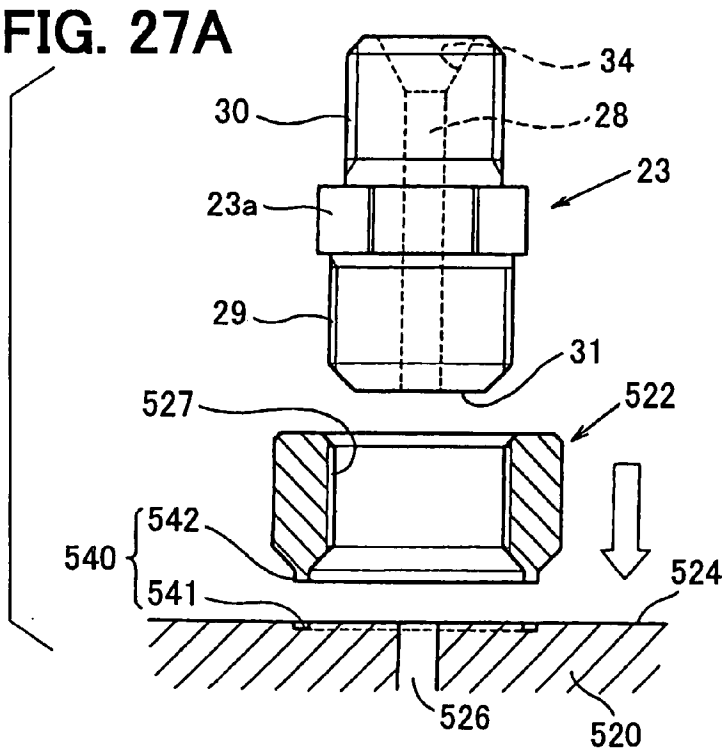
FIG. 27A is a view showing a mounting method of a pipe connector according to the FIG. 25 embodiment.
Figure 27B:
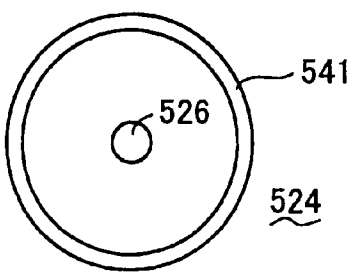
FIG. 27B is a plan view showing a cavity on a first flat surface of the common rail according to the FIG. 25 embodiment.
Figure 27C:
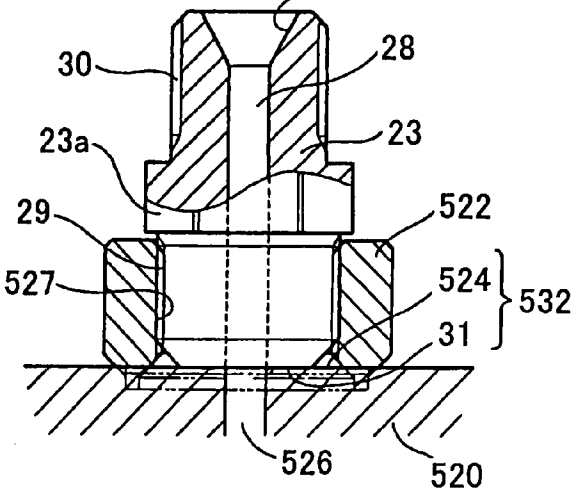
FIG. 27C is a sectional view showing the common rail and the pipe connector according to the FIG. 25 embodiment.
Figure 27D:
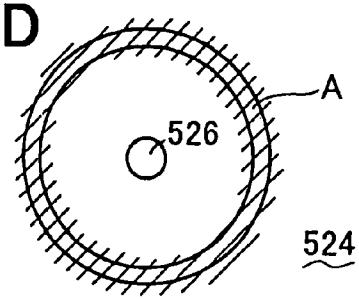
FIG. 27D is a plan view showing a welded portion according to the FIG. 25 embodiment.
Figure 28C:
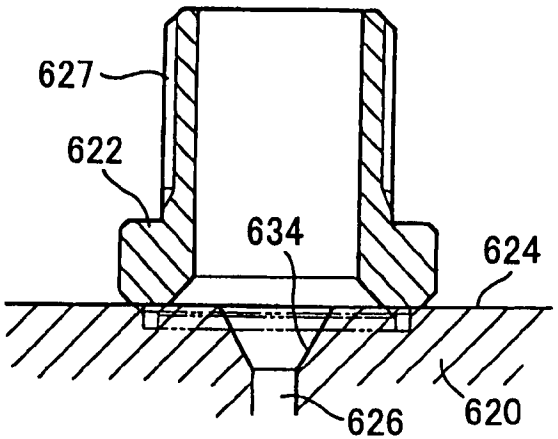
FIG. 28C is a sectional view showing the common rail and the pipe connector.
Figure 28D:
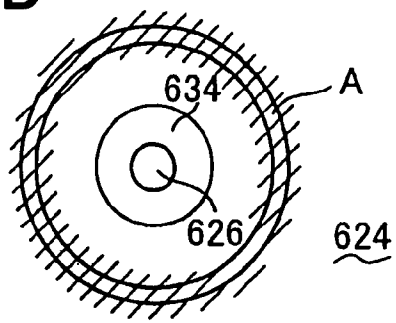
FIG. 28D is a plan view showing a welded portion.
Figure 28A:
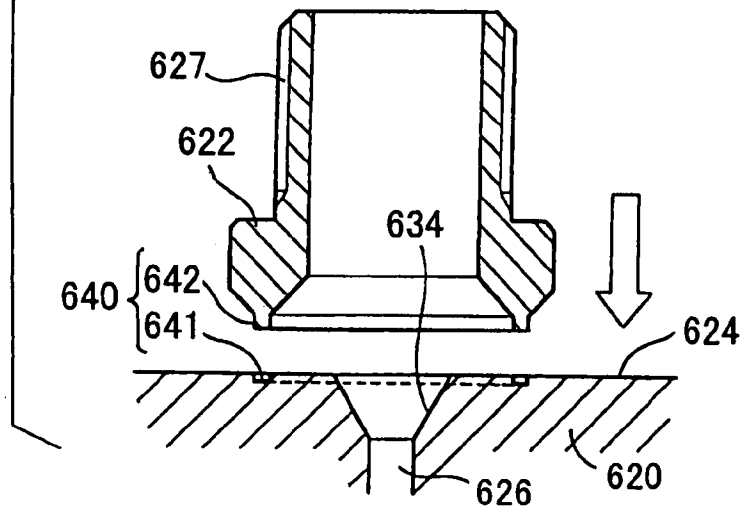
FIG. 28A is a view showing a mounting method of a pipe connector according to another example embodiment of the present invention.
Figure 28B:
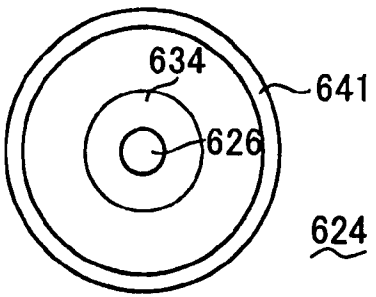
FIG. 28B is a plan view showing a cavity on a first flat surface of a common rail.
Figure 29A:
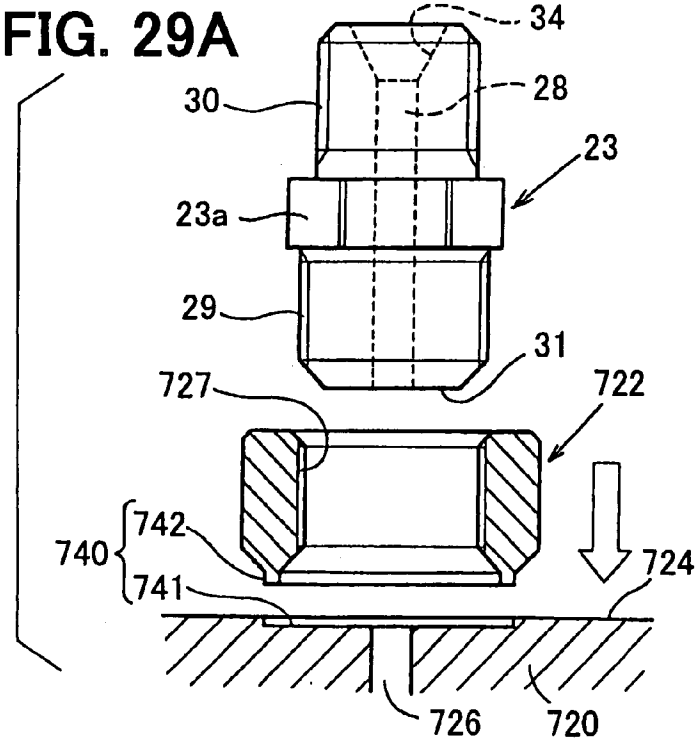
FIG. 29A is a view showing a mounting method of a pipe connector according to another example embodiment of the present invention.
Figure 29B:
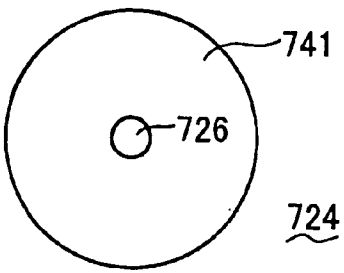
FIG. 29B is a plan view showing a cavity on a first flat surface of a common rail.
Figure 29C:
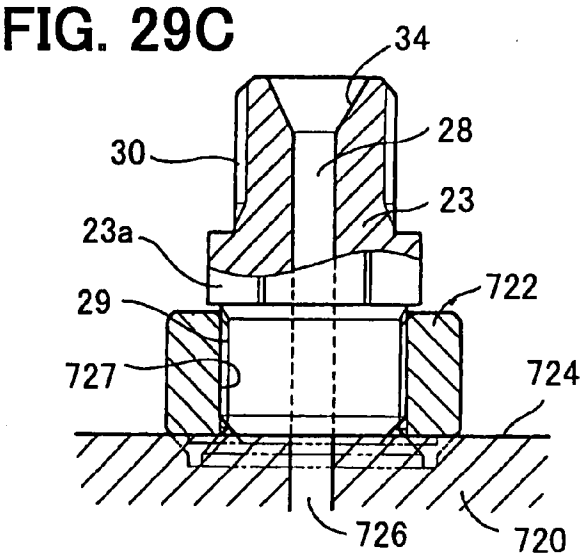
FIG. 29C is a sectional view showing the common rail and the pipe connector.
Figure 29D:
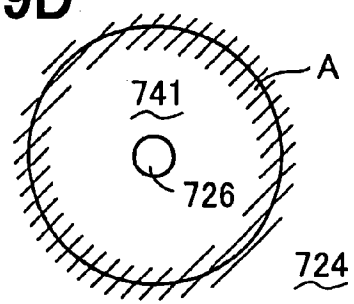
FIG. 29D is a plan view showing a welded portion.
Figure 30A:
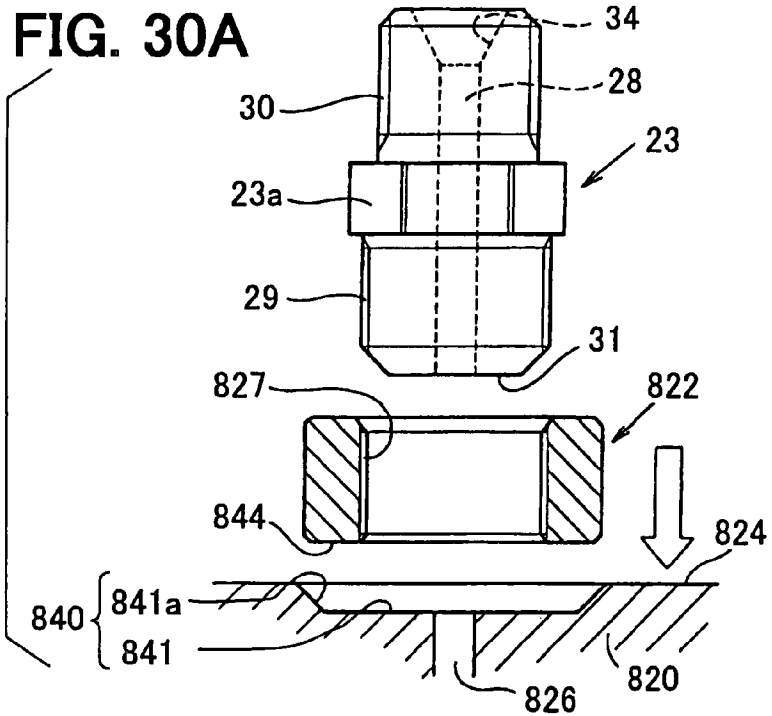
FIG. 30A is a view showing a mounting method of a pipe connector according to yet another example embodiment of the present invention.
Figure 30B:
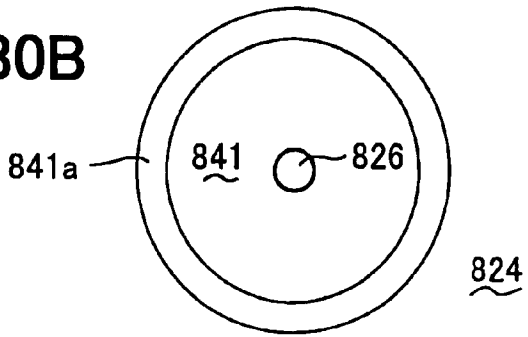
FIG. 30B is a plan view showing a cavity on a first flat surface of a common rail.
Figure 30C:
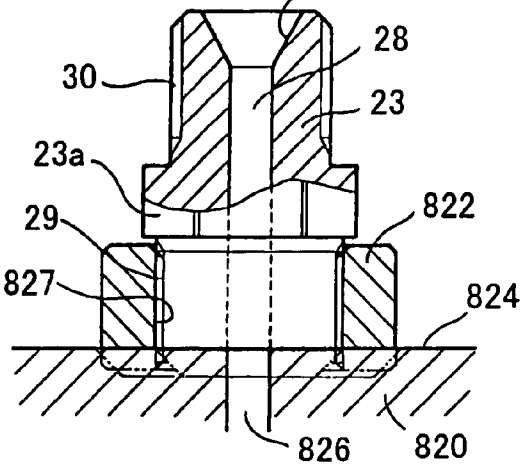
FIG. 30C is a sectional view showing the common rail and the pipe connector.
Figure 30D:
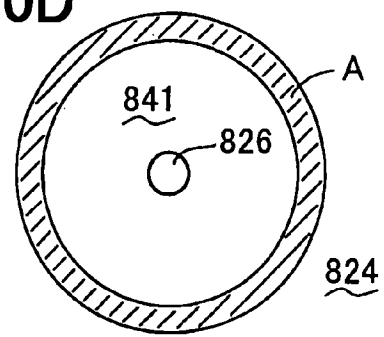
FIG. 30D is a plan view showing a welded portion.
Figure 31A:
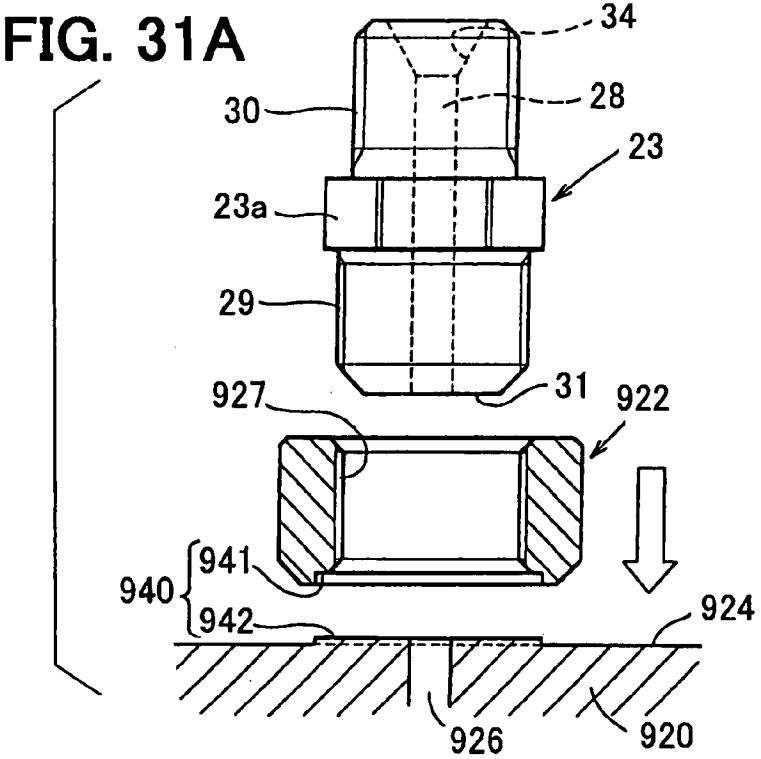
FIG. 31A is a view showing a mounting method of a pipe connector according to a further example embodiment of the present invention.
Figure 31C:
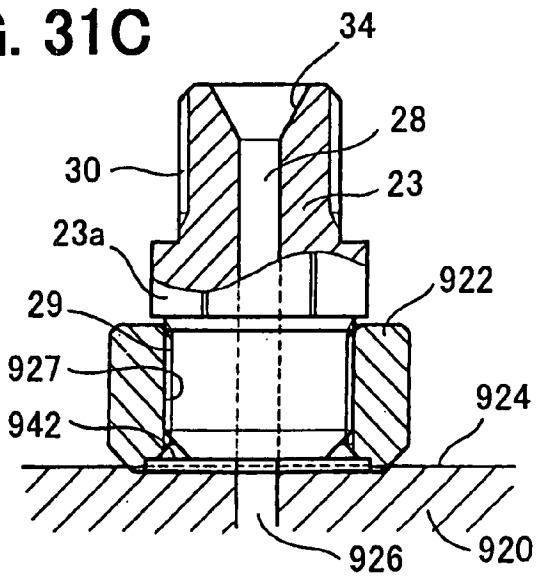
FIG. 31C is a sectional view showing the common rail and the pipe connector.
Figure 31D:
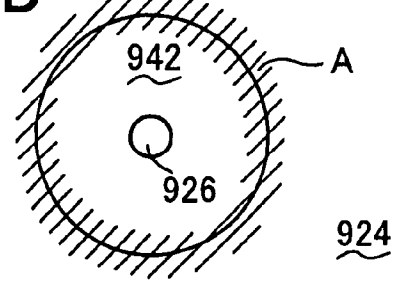
FIG. 31D is a plan view showing a welded portion.
Figure 31B:
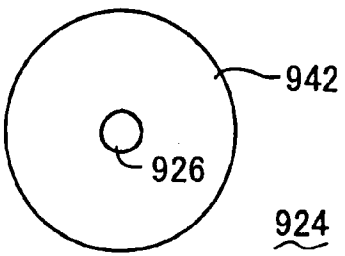
FIG. 31B is a plan view showing a cavity on a first flat surface of a common rail.
Figure 32A:
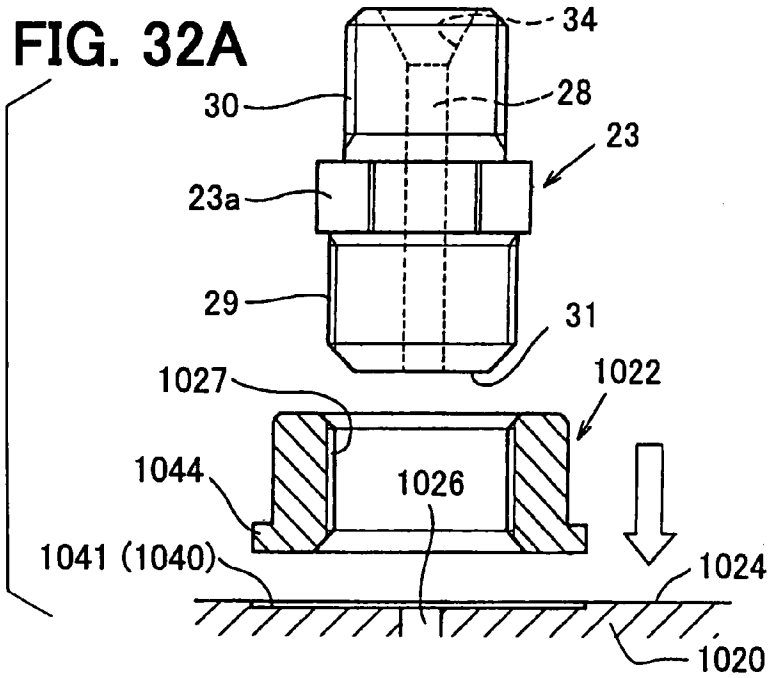
FIG. 32A is a view showing a mounting method of a pipe connector according to yet another example embodiment of the present invention.
Figure 32B:
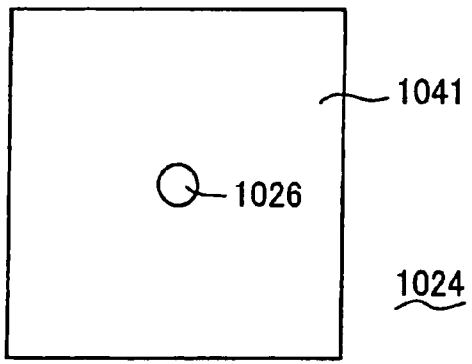
FIG. 32B is a plan view showing a cavity on a first flat surface of a common rail.
Figure 32C:
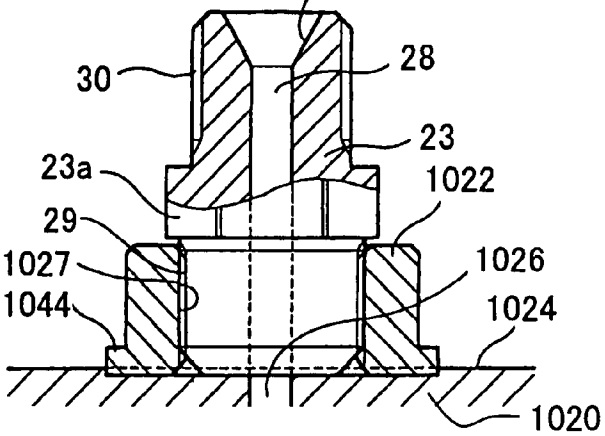
FIG. 32C is a sectional view showing the common rail and the pipe connector.
Figure 32D:
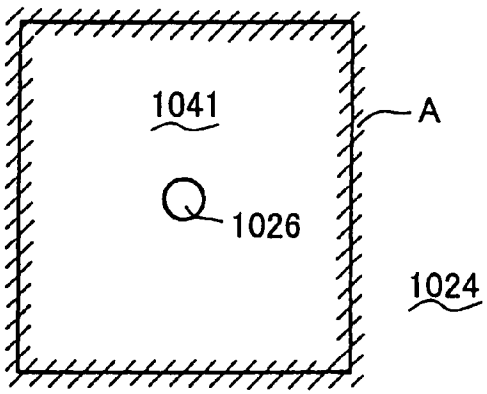
FIG. 32D is a plan view showing a welded portion.
Figure 33C:
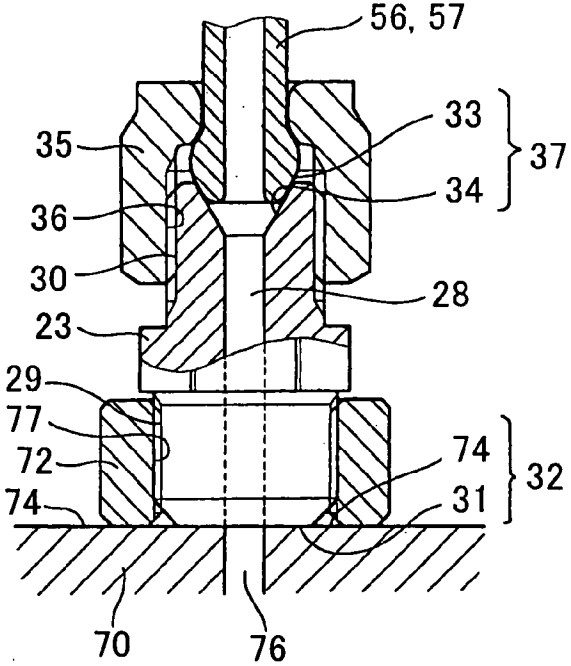
FIGS. 33A-33C are views showing a mounting method of a pipe connector of a related art.
Figure 33B:
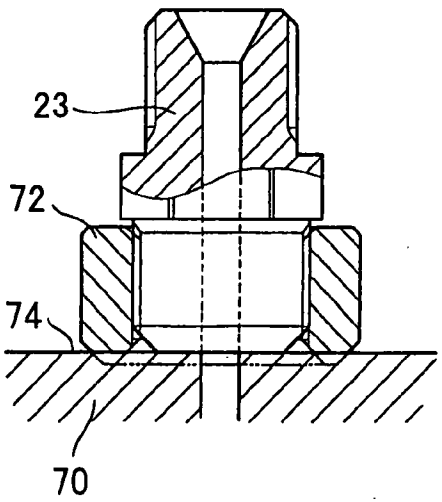
Figure 33A:
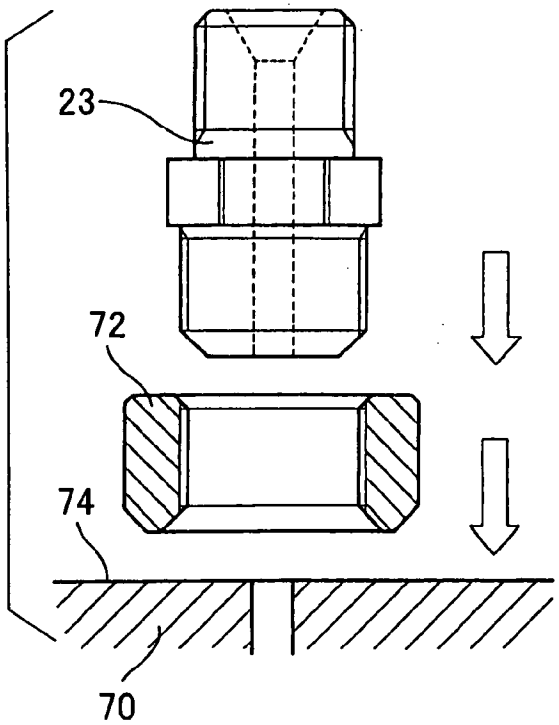
Figure 34C:
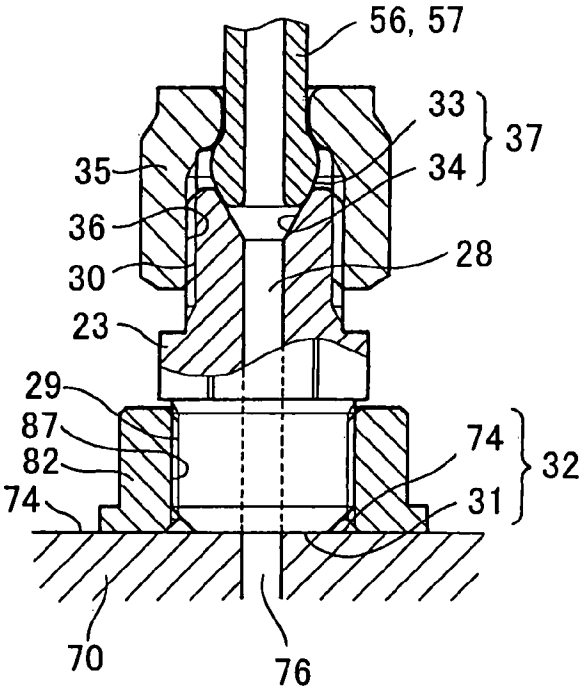
FIGS. 34A-34C are views showing a mounting method of a pipe connector of another related art.
Figure 34B:
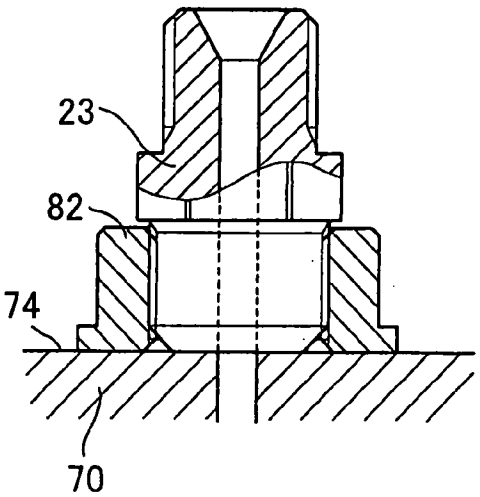
Figure 34A:
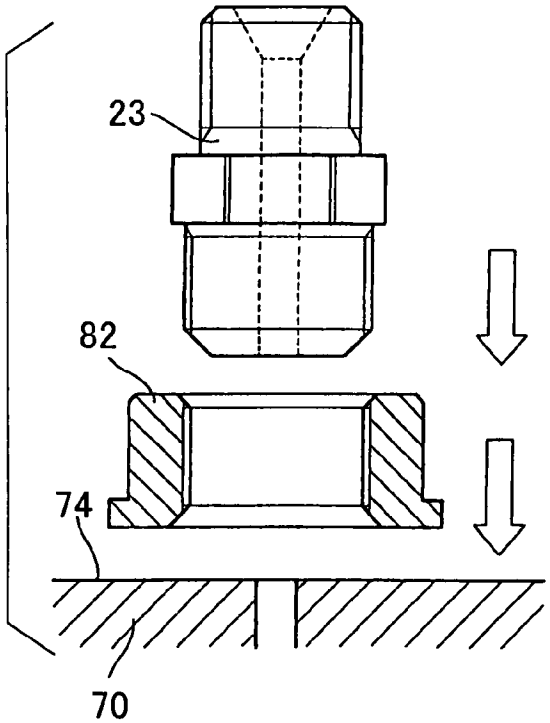

When the connector 522 is electric-welded to the rail main body 520, the annular protrusion 542 formed on the tip end of the connector 522 is fit into the annular cavity 541 formed on the first flat surface 524 of the rail main body 520, first. Then, an electrode of an electric welding device applies a vertical load onto the connector 522 against the first flat surface 524 along an arrow mark shown in FIG. 27A. Then, high voltage and high current are applied to the rail main body 520 and the connector 522. Thus, the contacting portions of the rail main body 520 and the connector 522 are welded into an annular shape as shown in FIG. 27D. A shaded area "A" in FIG. 27D designates a welded portion. The fit portions of the cavity 541 and the protrusion 542 are covered by the connector 522 through the welding process.

Then, the joint 23 is threaded to the inside of the connector 522 to form the common rail 51, to which each one of the pipes 56, 57 can be connected.

The common rail 51 of this embodiment is a bonded common rail manufactured by welding the rail main body 520 and the connector 522. The positioning portion 540, at which the rail main body 520 and the connector 522 fit each other, is formed at the position where the rail main body 520 and the connector 522 contact each other when the welding process is performed. The welding process is performed while the protrusion 542 is fit into the cavity 541. Thus, the rail main body 520 and the connecter 522 are welded while maintaining high welding accuracy.

Thus, by forming the positioning portion 540 at the contacting portions of the rail main body 520 and the connector 522, the bonding accuracy between the rail main body 520 and the connector 522 can be improved. More specifically, the bonding accuracy between the rail main body 520 and the connector 522 can be surely improved in a simple and cost-effective way.

The positioning portion 540 is provided by the cavity 541 formed in the rail main body 520 and the protrusion 542 formed on the connector 522. The cavity 541 and the protrusion 542 are formed in the annular shapes to fit with each other. Therefore, the rail main body 520 and the connector 522 can be surely welded with each other in the annular shape, and high welding strength can be attained.

Figure 35C:
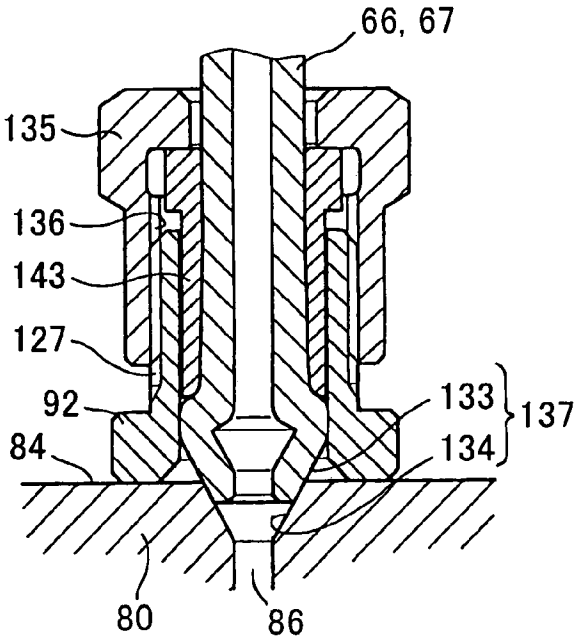
FIGS. 35A-35C are views showing a mounting method of a pipe connector of yet another related art.
Figure 35B:
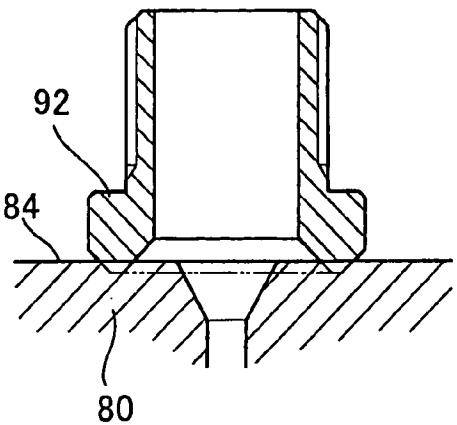
Figure 35A:
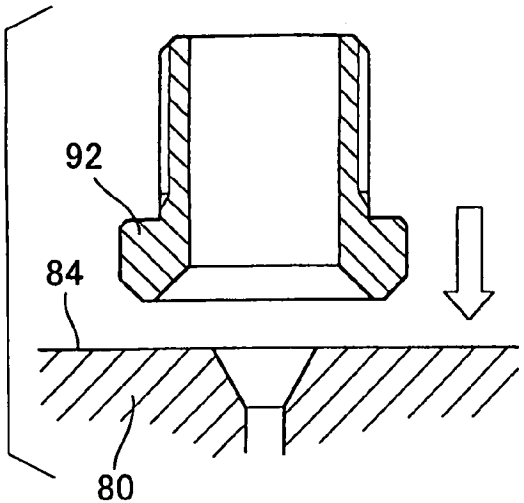

A common rail according to a further example embodiment of the present invention is illustrated in FIGS. 28A to 28D. The common rail of this embodiment is a sleeve type common rail generally of the type depicted in FIG. 35C.

The pressure receiving seat surface 634 in a conically-tapered shape is formed on a first flat surface 624 of the rail main body 620. An inside-outside communication hole 626 opens in the bottom of the pressure receiving seat surface 634. A connector thread (male thread, in the present embodiment) 627 is formed on an outer peripheral surface of the connector 622.

The common rail of this embodiment is a bonded common rail manufactured by welding the rail main body 620 and the connector 622. In this embodiment, a positioning portion 640 is provided by a cavity 641 and a protrusion 642 at contacting portions of the rail main body 620 and the connector 622. The rail main body 620 and the connector 622 fit each other at the positioning portion 640. Thus, the bonding portions of the rail main body 620 and the connector 622 can be maintained accurately when the welding process is performed. Thus, bonding accuracy between the rail main body 620 and the connector 622 can be surely improved.

A common rail according to another example embodiment of the present invention is illustrated in FIGS. 29A to 29D. An annular protrusion 742 is formed on a connector 722, and a cavity (recess) 741 is formed on a first flat surface 724 of a rail main body 720. An inside-outside communication hole 726 is formed in the first flat surface 724. A connector thread 727 is formed on an inner peripheral surface of the connector 722. The outer periphery of the protrusion 742 is fit into the cavity 741. The cavity 741 is formed at a portion of the first flat surface 724, at which the connector 722 is connected. The cavity 741 is formed in the shape of a recess having a circular bottom (surface parallel to the first flat surface 724). The annular protrusion 742 is fit to the circular bottom of the cavity 741. More specifically, the outer periphery of the annular protrusion 742 coincides with the periphery of the cavity 741, and the annular protrusion 742 is fit into the inside of the cavity 741. Thus, the annular protrusion 742 and the cavity 741 provides a positioning portion 740.

Thus, the accuracy of the bonding positions of the rail main body 720 and the connector 722 can be maintained at high accuracy when the welding process is performed. As a result, the bonding accuracy between the rail main body 720 and the connector 722 can be surely improved.

A common rail according to a further embodiment of the present invention is illustrated in FIGS. 30A to 30D. A base portion 844 (portion bonded to a rail main body 820) of a connector 822 is formed in a simple cylindrical shape. A cavity 841 is formed on a first flat surface 824. An inside-outside communication hole 826 is formed in the bottom surface of the cavity 841. The outer peripheral wall of the cavity 841 is tapered to produce a tapered surface 841*a*, the diameter of which increases outward. The peripheral edge of the base portion 844 contacts the tapered surface 841*a*. A connector thread 827 is formed on an inner peripheral surface of the connector 822.

Thus, the center of the connecter 822 is aligned with the center of the cavity 841 by the tapered surface 841*a* of the cavity 841 when the electric resistance welding process is performed while applying a vertical load onto the connector 822 against the first flat surface 824. The cavity 841 having the tapered surface 841*a* provides a positioning portion 840. Thus, though no protrusion is formed on the connector 822, the positional accuracy between the rail main body 820 and the connector 822 can be improved by forming the cavity 841 on the rail main body 820. Therefore, the cost required for the positioning can be limited.

A common rail according to yet another embodiment of the present invention is illustrated in FIGS. 31A to 31D.

In the common rail according to this embodiment, a protrusion 942 is formed on a first flat surface 924 of a rail main body 920, and the protrusion 942 is fit to a connector 922.

More specifically, the protrusion 942 is a circular protrusion formed on the first flat surface 924. An upper surface of the protrusion 942 is parallel to the first flat surface 924. The center of the circular protrusion 942 coincides with center of an outside opening of an inside-outside communication hole 926.

A cavity 941 (stepped portion) 941 is formed on a lower surface (surface contacting the rail main body 920) of the connector 922. The cavity 941 coincides with and fits the protrusion 942. The depth of the cavity 941 is set larger than the height of the protrusion 942. When the welding process is performed, the current flows to concentrate at points of the first flat surface 924 and the tip end of the connector 922, that contact each other. The cavity 941 and the protrusion 942 provide a positioning portion 940. The portions of the cavity 941 and the protrusion 942 that fit to each other are covered by the connector 122 through the welding process.

Thus, the bonding positions of the rail main body 920 and the connector 922 can be maintained accurately when the welding process is performed, and the bonding accuracy between the rail main body 920 and the connector 922 can be surely improved.

The cavity 941 of the connector 922 may be omitted, and the positioning may be attained by fitting the protrusion 942 formed on the rail main body 920 to the inner peripheral wall of the connector 922.

A common rail according to another embodiment of the present invention is illustrated in FIGS. 32A to 32D.

A connector 1022 according to this embodiment is bonded to the rail main body 1020 through a laser welding process. A connector thread 1027 is formed on an inner peripheral surface of the connector 1022. A base portion 1044 is formed on a portion of the connector 1022 that contacts the rail main body 1020. The base portion 1044 extends radially outward compared to the other part of the connector 1022. A lower surface (surface contacting the rail main body 1020) of the base portion 1044 is a flat surface coinciding with a bottom surface (flat surface parallel to the first flat surface 1024) of a cavity 1041. An inside-outside communication hole 1026 is formed in the bottom surface of the cavity 1041. The base portion 1044 is formed in a rectangular shape (square in the illustrated example) when the base portion 1044 is seen from the lower surface thereof. However, the shape of the base portion 1044 is not limited to the rectangular shape. Any other shape such as another polygonal shape or a circular shape can be employed as the shape of the base portion 1044.

A positioning portion 1040 according to this embodiment is a cavity 1041 formed on the rail main body 1020. The base portion 1044 of the connector 1022 is fit into the cavity 1041. More specifically, the cavity 1041 is a recess having a rectangular bottom formed at a position on the first flat surface 1024 where the connector 1022 is bonded. The rectangular base portion 1044 is fit onto the rectangular bottom of the cavity 1041. The peripheral edge of the rectangular base portion 1044 coincides with the periphery of the cavity 1041. Thus, the base portion 1044 fits inside of the cavity 1041.

When the connector 1022 is laser-welded to the rail main body 1020, the base portion 1044 of the connector 1022 is fit into the cavity 1041, which is formed on the first flat surface 1024 of the rail main body 1020 with a rectangular bottom. Then, a surrounding area of the fit portions of the cavity 1041 and the base portion 1044 is weld through a laser-welding process.

Then, the joint 23 is fastened into the connector 1022. Thus, the common rail, to which each one of the pipes 56, 57 can be connected, is completed.

Thus, also in the case where the rail main body 1020 and the connector 1022 are welded through the laser-welding process, the accuracy of the bonding position between the rail main body 1020 and the connector 1022 can be maintained high. Thus, the bonding accuracy between the rail main body 1020 and the connector 1022 can be improved.

In this embodiment, the positioning can be performed by forming the cavity 1041 on the first flat surface 1024 of the rail main body 1020. Therefore, the cost required to perform the positioning can be limited.

An orifice for reducing pressure pulsation may be formed in the joint 23. A plate formed with an orifice may be interposed between the joint 23 and the rail main body 520, 620, 720, 820, 920, 1020. A flow damper for reducing the pressure pulsation may be provided in the joint 23. A safety valve may be provided to stop a flow of the fuel through the joint 23 when the fuel flow rate through the joint 23 increases.

The connector 522, 622, 722, 822, 922, 1022 and the joint 23 may be integrated, and then, may be welded to the rail main body 520, 620, 720, 820, 920, 1020.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method for bonding a connecting member through a welding process to a metal base material used in a pressure accumulation fuel injection system that injects high-pressure fuel accumulated in a common rail into an internal combustion engine through an injector, wherein the connecting member is formed with a connecting portion, the metal base material including a positioning portion defined by at least one of a protrusion or a recess for engaging the connecting portion of the connecting member, the method comprising:

engaging said connecting member to the metal base material at said positioning portion; and performing the welding process while the connecting portion is positioned to the positioning portion of the metal base material, wherein:

the connecting portion is formed in an annular shape having thickness gradually reduced toward a tip end thereof; and the connecting portion is formed with a protrusion on the tip end thereof.

2. The method as in claim 1, wherein the metal base material is formed with a ring-shaped groove on a surface thereof.

3. The method as in claim 2, wherein at least one of an inner peripheral side and an outer peripheral side of the protrusion is restricted by at least one of side surfaces of the groove, whereby the connecting member is positioned.

4. The method as in claim 1, wherein the metal base material is formed with a recess on a surface thereof.

5. The method as in claim 1, wherein:

the fuel injection system has a high-pressure pipe for supplying the high-pressure fuel from the common rail to the injector; and the connecting member is a pipe connector for connecting the high-pressure pipe to the common rail as the metal base material.

6. The method as in claim 1, wherein:

the fuel injection system has a fuel supply pump for pressure-feeding the fuel to the common rail through a fuel pipe; and the connecting member is a pipe connector for connecting the fuel pipe to the common rail as the metal base material.

7. The method as in claim 1, wherein the connecting member is a connector for connecting a pressure sensor, a pressure reduction valve, or a pressure regulation device to the common rail as the metal base material.

8. The method as in claim 1, wherein the connecting member is a fixing connector for fixing a bracket to the common rail as the metal base material.

9. The method as in claim 1, wherein:

the fuel injection system has a fuel supply pump for pressure-feeding the fuel to the common rail through a fuel pipe; and the connecting member is a pipe connector for connecting the fuel pipe to a cylinder head of the fuel supply pump as the metal base material.

10. The method as in claim 1, wherein:

the fuel injection system has a high-pressure pipe for supplying the high-pressure fuel from the common rail to the injector; and the connecting member is a pipe connector for connecting the high-pressure pipe to a body of the injector as the metal base material.

11. A method for bonding a mounting stay formed in a cylindrical shape, whose outer peripheral surface has a circular section, through resistance welding process to a common rail of a pressure accumulation fuel injection system that injects high-pressure fuel accumulated in the common rail into an internal combustion engine through an injector, wherein the common rail is mounted to the internal combustion engine through the mounting stay and wherein the common rail is formed with a positioning cavity having a predetermined width along a longitudinal direction thereof, the method comprising:

bonding the mounting stay to the common rail while the outer peripheral surface of the stay is held by both edges of the positioning cavity provided along the longitudinal direction thereof, whereby the stay is positioned with respect to the longitudinal direction of the common rail.

12. The method as in claim 11, wherein:

the common rail is formed with chamfered portions at both edges of the positioning cavity provided along the longitudinal direction thereof; and the outer peripheral surface of the mounting stay is held by the chamfered portions, whereby the stay is positioned.

13. The method as in claim 11, wherein:

the mounting stay is formed with flange portions at both ends of the cylindrical shape; and the common rail is formed with a positioning portion fitting between both flange portions of the mounting stay.

14. A method for bonding a mounting stay having a positioning cavity, which has a predetermined width, through resistance welding process to a common rail of a pressure accumulation fuel injection system that injects high-pressure fuel accumulated in the common rail into an internal combustion engine through an injector, wherein the common rail is mounted to the engine through the mounting stay and wherein the common rail is formed with an outer peripheral surface having a circular section, to which the mounting stay is bonded, the method comprising:

bonding the mounting stay to the common rail while both edges of the positioning cavity contact the outer peripheral surface of the common rail having the circular section so that a center of the positioning cavity is aligned with a center of the common rail.

15. The method as in claim 14, wherein:

the mounting stay is formed with chamfered portions at both edges of the positioning cavity; and the outer peripheral surface of the common rail having the circular section contact the chamfered portions, whereby the mounting stay is positioned.

16. The method as in claim 14, wherein:

the common rail is formed with a concave positioning groove having a predetermined width with respect to a longitudinal direction thereof on an outer peripheral surface thereof; and the mounting stay is fit into the positioning groove, whereby the mounting stay is positioned with respect to the longitudinal direction of the common rail.

17. A common rail having a first member and a second member welded with each other, the first member including a positioning portion defined by at least one of a protrusion or recess at a position where the first member and the second member contact when the welding is performed, wherein the first member and the second member fit to engage each other at the positioning portions, wherein:

the positioning portion is provided by a cavity formed on the first member and a protrusion that is formed on the second member and fits with the cavity;

the protrusion is formed in an annular shape; and the cavity is formed in the shape of an annular groove, which fits with the protrusion, or a recess, to which an outer periphery of the protrusion fits.

18. The common rail as in claim 17, wherein:

the positioning portion is a cavity formed on the first member; and at least a part of the second member is fit into the cavity.

19. The common rail as in claim 17, wherein the cavity is formed on a flat surface of the first member.

20. The common rail as in claim 18, wherein the cavity is formed on a flat surface of the first member.

21. The common rail as in claim 17, wherein one of the first and second members is a rail main body for accumulating high-pressure fuel therein and the other one of the first and second members is a part of a pipe connecter for connecting a pipe to the common rail.

* * * * *